US008469617B2

(12) United States Patent
Ishida

(10) Patent No.: US 8,469,617 B2
(45) Date of Patent: Jun. 25, 2013

(54) PRINTER PLATEN SUPPORT MECHANISM AND ROLL PAPER PRINTER

(75) Inventor: Tetsugo Ishida, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 352 days.

(21) Appl. No.: 12/894,852

(22) Filed: Sep. 30, 2010

(65) Prior Publication Data

US 2011/0097131 A1 Apr. 28, 2011

(30) Foreign Application Priority Data

Oct. 23, 2009 (JP) ..... 2009-244209

(51) Int. Cl.
*B41J 11/00* (2006.01)

(52) U.S. Cl.
USPC ..... 400/649; 400/691; 400/693; 400/611

(58) Field of Classification Search
USPC ..... 400/649, 692, 693, 650, 648, 611, 400/691
See application file for complete search history.

(56) References Cited

U.S. PATENT DOCUMENTS

| | | | | |
|---|---|---|---|---|
| 5,274,399 | A * | 12/1993 | Uchida et al. | 346/134 |
| 5,940,092 | A * | 8/1999 | Kashimura et al. | 347/8 |
| 6,474,883 | B1 | 11/2002 | Kawakami et al. | |
| 7,563,045 | B2 | 7/2009 | Nagata | |

FOREIGN PATENT DOCUMENTS

| | | | |
|---|---|---|---|
| JP | 07-184725 | A | 7/1995 |
| JP | 10-085055 | A | 4/1998 |
| JP | 2001-158142 | A | 6/2001 |
| JP | 2007-83478 | A | 10/2008 |

* cited by examiner

*Primary Examiner* — Matthew G Marini
(74) *Attorney, Agent, or Firm* — Nutter McClennen & Fish LLP; John J. Penny, Jr.; Christina M. Sperry

(57) ABSTRACT

A platen support mechanism of a printer moves a platen unit of the printer. When moving the platen unit from a closed position to an open position, the platen support mechanism of the printer first moves the platen unit along a straight first path, and then moves the platen unit along a curved second path. A posture of the platen unit is held constant during this time by a six joint linkage mechanism.

16 Claims, 15 Drawing Sheets

PRINTER PLATEN SUPPORT MECHANISM AND ROLL PAPER PRINTER

CROSS REFERENCE TO RELATED APPLICATIONS

Priority is claimed under 35 U.S.C. §119 to Japanese Application No. 2009-244209 filed on Oct. 23, 2009, which is hereby incorporated by reference in its entirety.

BACKGROUND

1. Technical Field

The present invention relates to a printer platen support mechanism that can move a platen.

2. Related Art

When loading roll paper in a roll paper printer, the cover of the roll paper printer's roll paper compartment is opened, the roll paper loaded, and a recording paper web is pulled from the roll and threaded through a recording paper transportation path past the printing position of a print head. To simplify this task, a platen support mechanism may be configured so that a platen moves away from the printing position (from the print head disposed on the printer case side) and opens the recording paper transportation path when the cover of the roll paper compartment opens.

For example, Japanese Unexamined Patent Appl. Pub. JP-A-2001-158142, which corresponds to U.S. Pat. No. 6,474,883, teaches a platen support mechanism (cover opening and closing mechanism) that, for example, supports a platen unit to which the platen is disposed by means of a four joint parallel linkage mechanism, and moves the platen unit located directly above the roll paper compartment with the cover along an arcuate path to the front of the printer while holding the platen unit horizontal.

The platen unit also descends as front and back links that support the platen unit move forward with the platen support mechanism using a four joint parallel linkage mechanism. Sufficient space must therefore be opened below the platen unit (between the platen unit and roll paper) so that a bottom end of the platen unit does not interfere with the roll paper loaded in the roll paper compartment.

More specifically, when roll paper with the largest diameter compatible with the roll paper printer is loaded, sufficient space must be opened between the roll paper and the platen unit. While this space is needed for the platen unit to move, the height of the roll paper printer can be reduced and the printer size can be reduced if this space is reduced or eliminated.

SUMMARY

A platen support mechanism according to at least one embodiment of the present invention can move a platen, which defines a printing position where a print head prints on a recording medium, to a position removed from the printing position so that a recording medium transportation path is open at the printing position. The platen support mechanism thus enables reducing the space, e.g., as much space as possible, required for platen movement when the platen is moved to open the recording medium transportation path.

A roll paper printer according to an exemplary embodiment of the present invention has a platen support mechanism that can reduce as much as possible the space required for platen movement in conjunction with opening and closing a cover of the roll paper printer's roll paper compartment.

A first aspect of at least one embodiment of the invention is a printer platen support mechanism that supports a platen unit having a platen that defines a printing position of the print head so that the platen unit can move between a closed position where the platen defines the printing position and an open position separated from the closed position. The printer platen support mechanism includes a guide mechanism and a six joint linkage mechanism. The guide mechanism guides the platen unit to an intermediate position on a first path of movement between the closed position and the open position. The six joint linkage mechanism supports the platen unit guided along the first path of movement in a specific posture and causes the platen unit to move from the intermediate position to the open position along a curved second path of movement while held in a specific posture. The six joint linkage mechanism includes a first compound link having a first link and a second link connected in series at a first pin joint, a second compound link having a third link and a fourth link connected in series at a second pin joint, and a fifth link connected between the first pin joint of the first compound link and the second pin joint of the second compound link. A first end of the first compound link and a first end of the second compound link are connected respectively to a third pin joint and a fourth pin joint at defined front and back positions with a specific distance therebetween when the platen unit is seen in a direction opening from the closed position to the open position, and a second end of the first compound link and a second end of the second compound link are connected respectively to a fifth pin joint and a sixth pin joint at defined front and back positions of the platen unit with a specific distance therebetween when seen in the opening direction. When the platen unit is positioned above the first path of movement, a first gap between the third pin joint and the fifth pin joint, and a second gap between the fourth pin joint and the sixth pin joint, are less than respective maximum gaps therebetween, and when the platen unit moves from the first path of movement to the second path of movement, said first and second gaps increase to their respective maximum gaps.

When the platen unit moves from the closed position along the first path of movement with the platen support mechanism according to this aspect of at least one embodiment of the invention, the platen unit is guided by the guide mechanism and its posture is held constant by the six joint linkage mechanism. While the first compound link and the second compound link of the six joint linkage mechanism supporting the platen unit are guided along the first path of movement, the distances between the pin joints thereof are less than their respective maximum gaps. More specifically, the first and second compound links move while bent at the first and second pin joints.

When the platen unit moves from the first path of movement to the second path of movement, the gap between the pin joints at the ends of the first and second compound links of the six joint linkage mechanism increases to the maximum distance. More specifically, the first and second compound links become fully extended, and the first and second compound links thereafter function as links of a fixed length. As a result, the platen unit is supported by a four-joint parallel linkage mechanism with first and second compound links attached front and back in the opening direction of the platen unit. The platen therefore moves to the open position along a curved second path of movement while held in a constant posture by the fixed-length first and second compound links.

With the platen support mechanism according to this aspect of at least one embodiment of the invention, the platen unit is supported by the first and second compound links that are bent to a shorter length while moving along the first path of movement, and after moving from the first path of movement to the second path of movement, moves along the curved second path of movement with a large radius by means of the fully extended first and second compound links.

When a four joint parallel linkage mechanism of a fixed length is used, the platen unit must be moved from the beginning along a curved path with a large radius determined by long front and back links. At least one embodiment of the invention, however, can enable freely configuring a shape of the first path of movement, and thus can enable using a first path of movement that is straight, for example. Less space can therefore be needed to move the platen unit along the first path of movement than when the platen unit is moved along a curved path of movement from the closed position. The size of the printer can therefore be reduced accordingly.

The printer platen support mechanism can have any number of variations. The guide mechanism can have a platen unit guide channel that defines the first path of movement, and a slide member that can slide along the platen unit guide channel. The platen unit can include a part of the platen unit guide channel and the slide member, and another part of the platen unit guide channel and the slide member can be disposed on a side of a printer frame. The platen unit can include a shaft member that determines a pivot center of the sixth pin joint of the second compound link, the slide member can include end parts of the shaft member, the printer frame can have a frame part disposed opposite the end parts, and the platen unit guide channel can be formed in each of the frame parts.

The platen support mechanism can include a holding mechanism that, when the platen unit is on the second path of movement, holds the first gap between the third pin joint and the fifth pin joint, and the second gap between the fourth pin joint and the sixth pin joint, at the maximum gaps therebetween.

When the platen unit moves from the first path of movement to the second path of movement, the platen unit is passed to the curved second path with the first and second compound links of the six joint parallel linkage mechanism fully extended. If the first and second compound links are not fully extended when returning from the curved second path of movement to the first path of movement, the position of the supported platen unit will shift and the platen unit cannot be passed smoothly from the second path of movement to the first path of movement. For example, the shaft ends on the sides of the platen unit cannot smoothly enter the platen unit guide channel of the guide mechanism defining the first path of movement, and the shaft ends may collide with the part of the printer frame where the platen unit guide channel is formed. However, because the first and second compound links can be held fully extended by the holding mechanism while moving on the second path, the position of the platen unit can be prevented from shifting when returning from the curved second path of movement to the first path of movement, and the platen unit can return smoothly to the first path of movement.

The holding mechanism can include, for example, a tension spring. A first end of the tension spring can be connected to the second pin joint of the second compound link, and a second end of the tension spring can be connected to a part of the printer frame positioned to the back of the second pin joint when the platen unit is seen in the opening direction. In another embodiment, a first end of the tension spring can be connected to the first pin joint of the first compound link, and a second end of the tension spring can be connected to a part of the printer frame positioned to the back of the first pin joint when the platen unit is seen in the opening direction.

The tension spring can be held in a specific extended state while the platen unit is on the second path of movement. In other words, the second pin joint can also move in the opening direction in conjunction with movement of the platen unit in the opening direction. The second compound link can be pulled to the fully extended state by the force of the tension spring, and as a result, the first compound link connected through the fifth link to the second compound link can also be pulled and held in the fully extended state.

Instead of or in addition to the holding mechanism including a tension spring, the holding mechanism can include a sliding expansion link attached to the six joint linkage mechanism, and a link guide surface disposed to the printer frame. The sliding expansion link can have a fixed-side link of which one end is connected to the fourth pin joint, and a slide-side link of which one end is connected to the sixth pin joint. A slide pin is disposed to another end of the slide-side link, and the slide pin is inserted to a slide channel formed in the fixed-side link so that the slide pin can slide in the slide channel. When the platen unit moves from the first path of movement to the second path of movement, the slide pin rides onto the link guide surface and the sliding expansion link is held extended, and when the platen unit moves from the second path of movement to the first path of movement, the slide pin separates from the link guide surface and the sliding expansion link can expand and contract freely. In another embodiment, the sliding expansion link can have a fixed-side link of which one end is connected to the third pin joint, and a slide-side link of which one end is connected to the fifth pin joint.

Because the first and second compound links can be held fully extended by the sliding expansion link mechanically held in an extended position, the position of the platen unit will not shift even if a strong shock is applied when the platen unit closes, and the action of returning from the second path to the first path can therefore be smooth.

The platen support mechanism of at least one embodiment of the invention can be particularly well suited to use in a roll paper printer that has a roll paper compartment. In one embodiment, a roll paper printer includes any platen support mechanism described herein; a roll paper compartment for storing roll paper, and an access cover that is attached to a front of the printer for opening and closing the roll paper compartment. The closed position of the platen unit is a position where the platen unit is disposed extending in a front-back direction of the printer above the roll paper compartment. The open position of the platen unit is a position where the platen unit is pulled from the roll paper compartment to the printer front and is disposed extending in the front-back direction of the printer at a position lower than the closed position. The access cover pivots at a bottom end of the access cover and opens and closes in the front-back direction of the printer in conjunction with movement of the platen unit.

If the platen unit is moved along a straight first path of movement that extends to the front of the printer to a position removed to the front from above the roll paper compartment, and the platen unit is then moved along a curved second path of movement, less space can be needed to move the platen unit than when the platen unit moves along a curved path of movement from the start. A large space therefore does not need to be rendered above the roll paper compartment so that the platen unit does not interfere with the stored roll paper. The height of the roll paper printer can therefore be reduced.

The roll paper printer can optionally include a paper feed roller pair for conveying recording paper delivered from the roll paper stored in the roll paper compartment past the printing position. A first roller of the paper feed roller pair can be disposed on the platen unit, and a second roller of the paper feed roller pair can be disposed to the printer frame side. When the platen unit is moved from the closed position to the open position, the platen and the first roller on the platen unit can separate from the print head and the second roller on the printer frame side, and the recording paper transportation path passing therebetween can become open. As a result, replacing the roll paper and threading the recording paper pulled from the installed paper roll through the recording paper transportation path can be simple.

In another aspect, a roll paper printer is provided that in at least one embodiment includes a roll paper compartment adapted to store roll paper, a print head, a platen disposed opposite the print head, a cover configured to open and close an opening for storing the roll paper in the roll paper compartment, a platen support mechanism that supports the platen movably to a first position opposite the print head and a second position separated from the print head, a main frame to which the print head is disposed, and a platen frame to which the platen is disposed and which is configured to move relative to the main frame by the platen support mechanism. The platen support mechanism includes a first compound link including a first link and a second link connected at a first joint, a second compound link including a third link and a fourth link connected at a second joint, a fifth link of which a first end is connected to the first joint and a second end is connected to the second joint, and a first guide unit. The first link and the third link are connected to the main frame by a third joint and a fourth joint, and the second link and the fourth link are connected to the platen frame by a fifth joint and a sixth joint. The first guide unit guides the sixth joint so that the platen moves along a straight first path from the first position to a third position that is located between the first position and the second position. A first distance between the third joint and the fifth joint, and a second distance between the fourth joint and the sixth joint, change while the sixth joint of the first compound link and the second compound link is guided by the first guide unit and the platen moves from the first position to the third position, and the platen thereby moves along the straight first path. The first distance between the third joint and the fifth joint, and the second distance between the fourth joint and the sixth joint, are constant, and the platen thereby moves along a curved second path while the sixth joint of the first compound link and the second compound link is not guided by the first guide unit and the platen moves from the third position to the second position.

The roll paper printer can vary in any number of ways. For example, the first guide unit can be a channel that is a stepped channel with at least one step, and can be formed so that the platen moves away from the print head from the first position to the third position. For another example, the platen support mechanism can include a holding mechanism that holds the first distance between the third joint and the fifth joint, and the second distance between the fourth joint and the sixth joint, constant while the platen moves along the second path from the third position to the second position. The two links of at least one of the first compound link and the second compound link can have contact parts that touch each other when the platen is on the second path, and the holding mechanism can have an urging member that urges the first joint and the second joint in a direction causing the contact parts of the two links to touch each other. The holding mechanism can include, e.g., a slide link mechanism that is disposed to either the first compound link or the second compound link, and that includes a sixth link with a slot connected to the third joint or the fourth joint, and a seventh link that is connected to the fifth joint or the sixth joint, and has two members that are inserted to the slot. A second guide unit can be disposed to the main frame and guides one of the two members of the slide link mechanism.

In another aspect, a printing device is provided that in at least one embodiment includes a platen unit and a linkage mechanism. The platen unit is coupled to a platen and is movable between a closed position, in which the platen defines a printing position of a print head, and an open position. The linkage mechanism is configured to move the platen unit between the open and closed positions, and includes a first compound link having a first joint, a second compound link having a second joint, and a link having one end coupled to the first joint and another end coupled to the second joint. The first and second compound links are configured to respectively pivot at the first and second joints to move the platen unit between the open and closed positions.

The printing device can vary in any number of ways. For example, the first compound link can include first and second links connected in series at the first joint such that the first and second links can pivot relative to one another about the first joint, and the second compound link can include third and fourth links connected in series at the second joint such that the third and fourth links can pivot relative to one another about the second joint. When the platen unit is in the closed position, the first and second compound links can be curved such that longitudinal axes of the first and second links are angled relative to one another and longitudinal axes of the third and fourth links are angled relative to one another. When the platen unit is in the open position, the first and second compound links can be extended such that the longitudinal axes of the first and second links are parallel to one another and the longitudinal axes of the third and fourth links are parallel to one another. For another example, one end of the first compound link can be coupled to the platen unit at a third joint, one end of the second compound link can be coupled to the platen unit at a fourth joint, and the first and second compound links can be configured to respectively pivot at the third and fourth joints to move the platen unit between the open and closed positions.

EFFECT OF THE INVENTION

Generally, a platen support mechanism as described herein supports a platen unit by means of a six joint linkage mechanism that replaces front and back links of a four joint parallel linkage mechanism with first and second compound links each having two links connected in series. In addition, while the platen unit moves from a closed position to an intermediate position, the platen unit is guided by a guide mechanism along a straight or other desired first path of movement while the posture of the platen unit is held in a specific position by the six joint linkage mechanism. In addition, after the platen unit moves to the an intermediate position at the end of the first path, the two compound links of the six joint linkage mechanism are fully extended, and the platen unit can move to the open position while held in the same position along a curved second path in the same way as with a four joint parallel linkage mechanism.

The platen support mechanism can thus enable reducing a size of a printer including the platen support mechanism because less space is needed for platen unit movement inside the printer than when the platen unit moves along a curved path from the start. Furthermore, because the first path of platen unit movement can be stepped or otherwise desirably configured, the parts on the printer side disposed around the path of platen unit movement can be arranged with greater freedom.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of an inkjet roll paper printer according to the present invention is described below with reference to the accompanying figures.

General Configuration of a Roll Paper Printer

Figure 1:
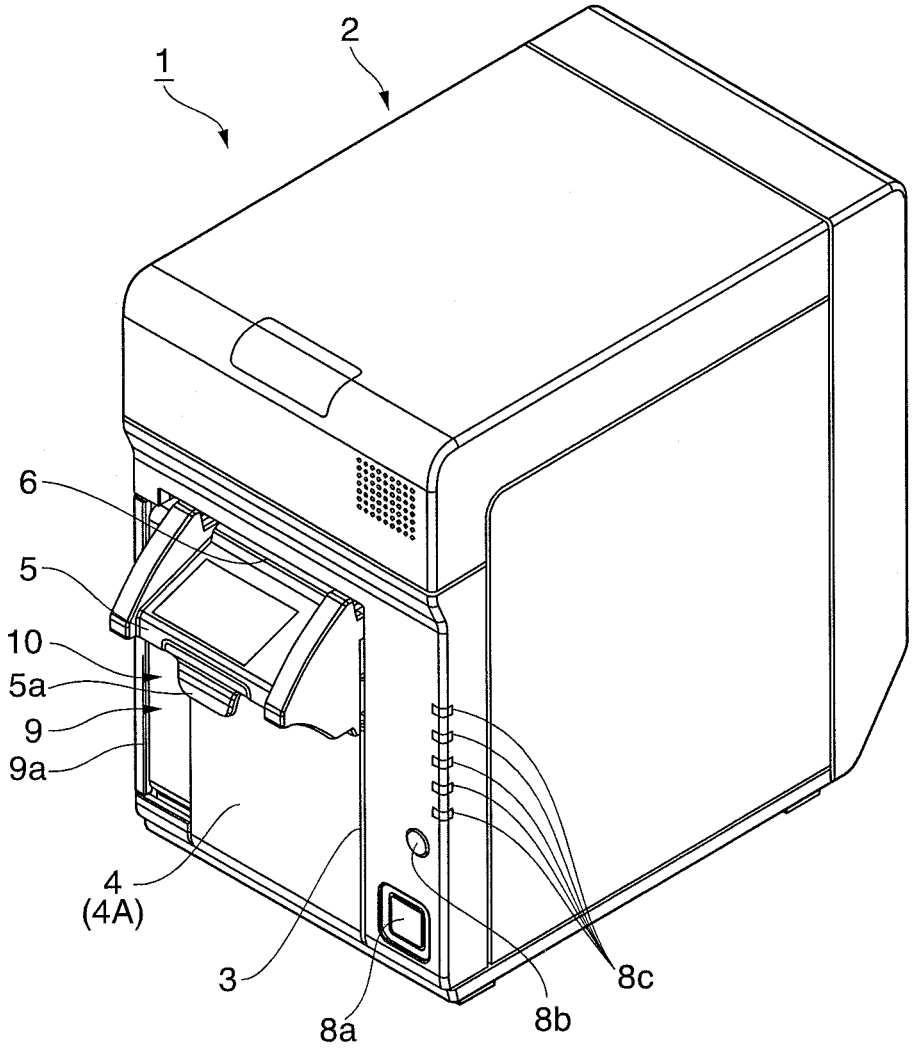
FIG. 1 is an oblique view of a roll paper printer according to one embodiment of the invention.
Figure 2:
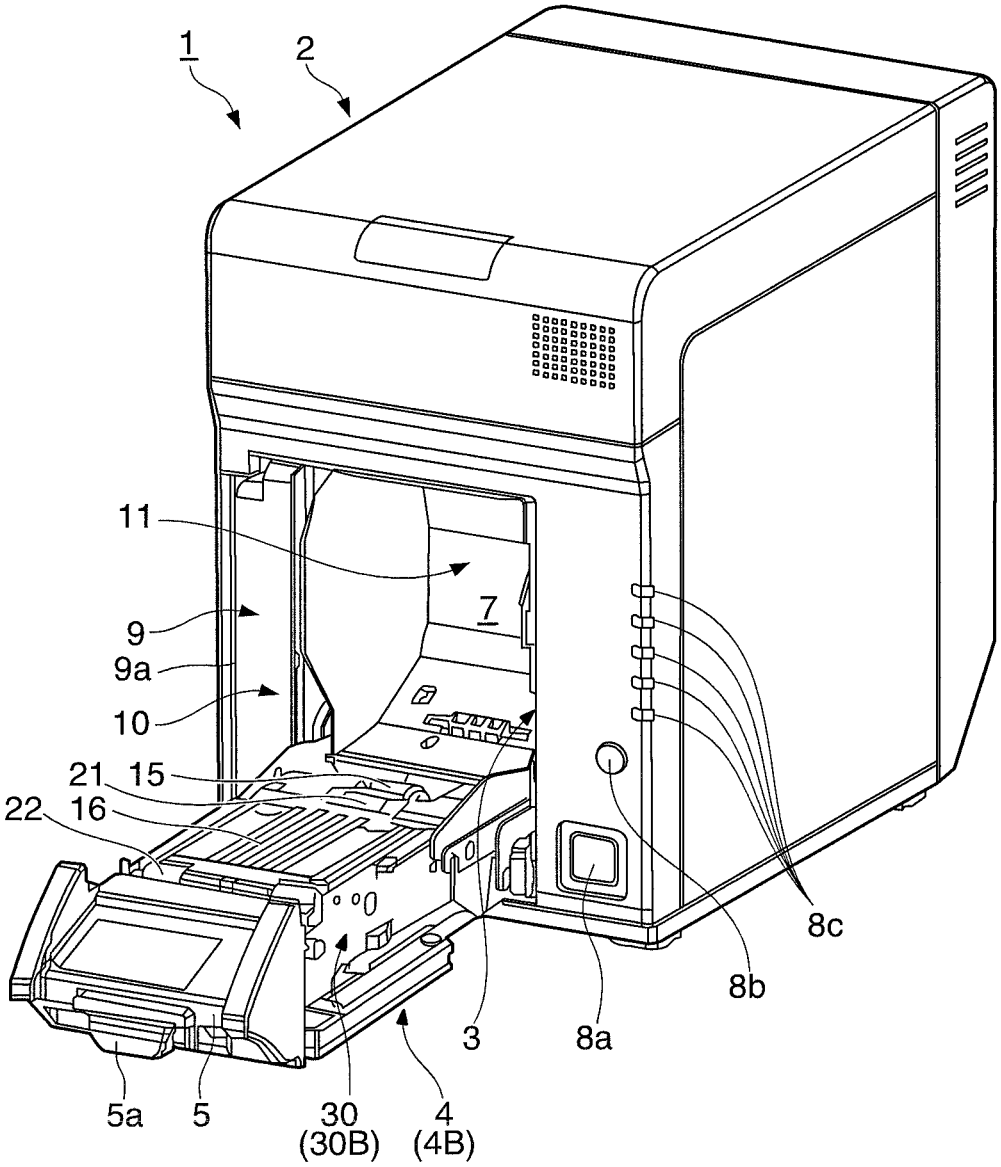
FIG. 2 is an oblique view showing the roll paper printer of FIG. 1 with a cover of the printer open.

A roll paper printer 1 (referred to below as a "printer") shown in FIG. 1 and FIG. 2 uses plural colors of ink to print in color on a web of recording paper that is delivered from a paper roll. The printer 1 has a case 2 with an opening 3 in a middle front part of the case 2 for loading roll paper. The opening 3 is opened and closed by a cover 4. A recording paper discharge guide 5 is disposed at a top end of the cover 4, and when the cover 4 is closed (closed position 4A) a recording paper exit 6 is formed between the discharge guide 5 and a top edge of the opening 3 in the case 2.

An operating tab 5*a* is attached protruding down from a position at a front bottom side of the discharge guide 5. When the operating tab 5*a* is pulled to a front of the printer 1, a lock (not shown in the figures) for the cover 4 is disengaged. When the lock is disengaged and the operating tab 5*a* is pulled further forward, the cover 4 can be opened forward and down from the closed position 4A shown in FIG. 1 to the open position 4B shown in FIG. 2. When the cover 4 is open, a roll paper compartment 7 formed inside the printer 1 is open, and the roll paper can be loaded or replaced.

A power switch 8*a*, a paper feed switch 8*b*, and a plurality of operating indicators 8*c* are disposed in the front of the case 2 on the right side of the cover 4. An opening 9*a* to an ink cartridge loading unit 9 is rendered in the front of the case 2 on a left side of the cover 4, and an ink cartridge 10 storing plural colors of ink is loaded in the ink cartridge loading unit 9.

Figure 3:
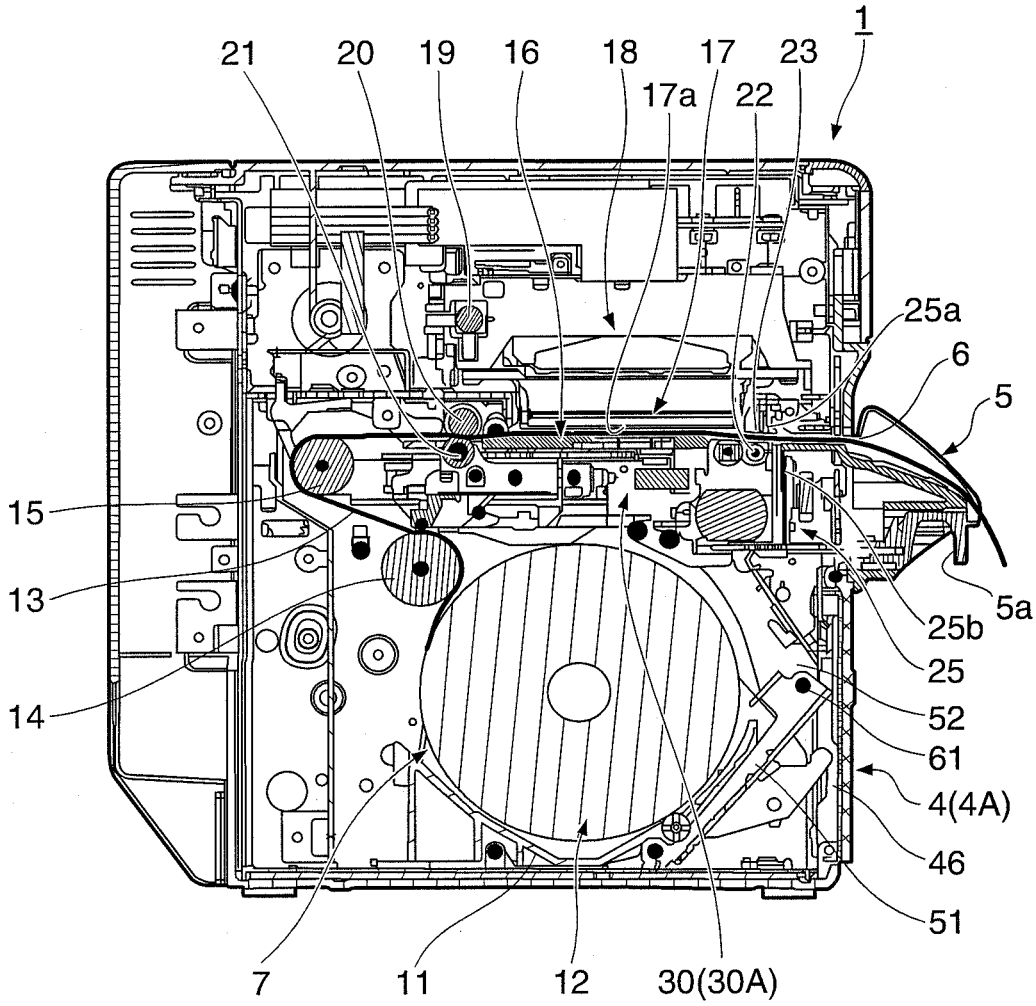
FIG. 3 is a vertical section view showing an internal configuration of the roll paper printer of FIG. 1.
Figure 4:
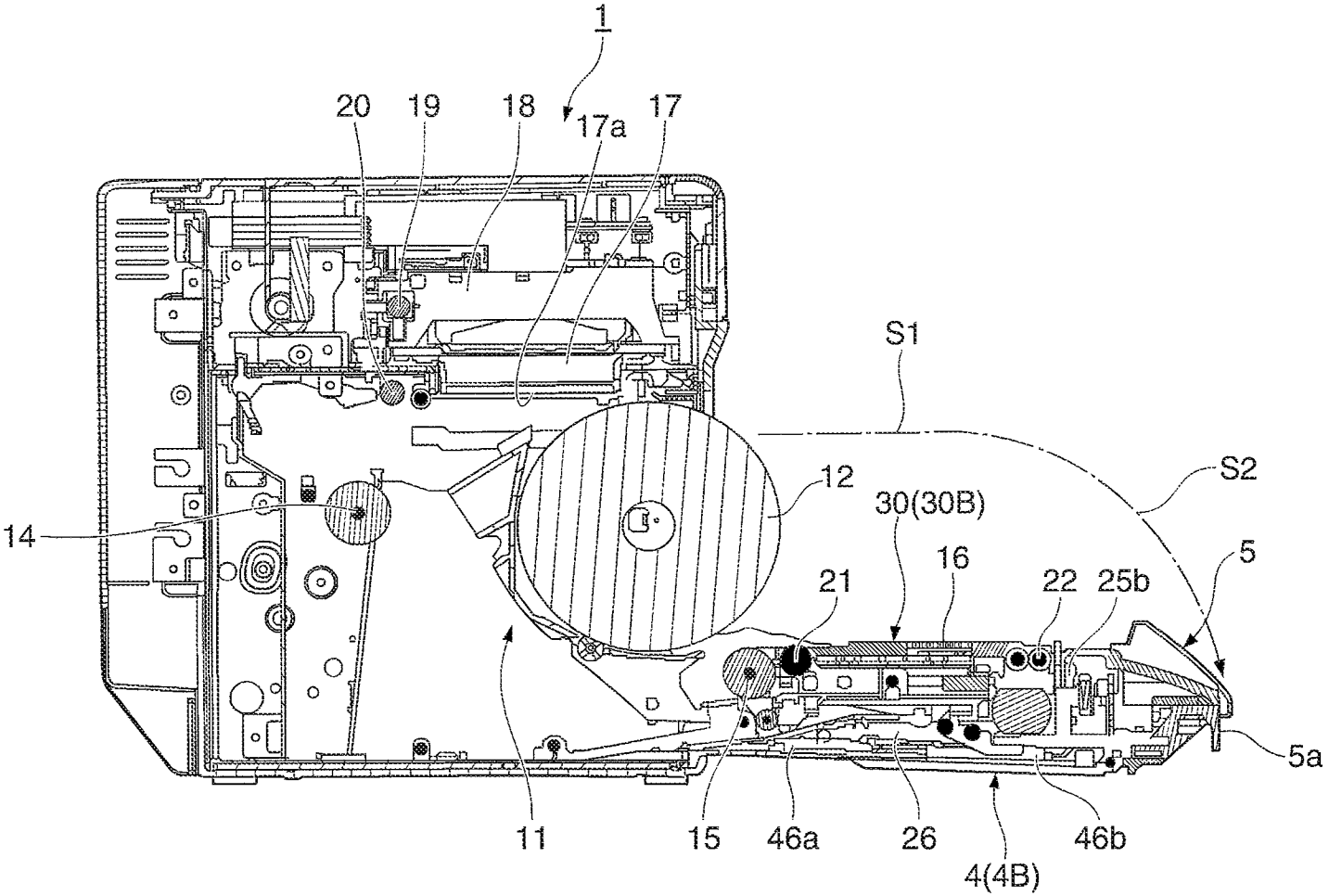
FIG. 4 is a vertical section view showing the internal configuration of the roll paper printer of FIG. 2.

The roll paper compartment 7 has a roll paper tray 11 with an arcuate section as shown in FIG. 3 and FIG. 4, and roll paper 12 is stored freely rotatably on the roll paper tray 11.

A platen 16 and a print head 17 (inkjet head) are disposed above the roll paper compartment 7. The print head 17 is mounted on a head carriage 18, and can move bidirectionally widthwise to the printer 1 along a guide shaft 19. A nozzle surface 17*a* of the print head 17 faces the top surface of the platen 16 with a specific gap therebetween.

A paper feed drive roller 20 is disposed behind the platen 16, and a paper feed follower roller 21 is pressed from below to the paper feed drive roller 20. A discharge drive roller 22 is disposed in front of the platen 16, and a discharge follower roller 23 is pressed from above to the discharge drive roller 22.

The web of recording paper 13 pulled from the roll paper 12 is conveyed past a feed roller 14 and a tension roller 15 disposed behind and above the feed roller 14 toward the platen 16. The recording paper 13 passes between the paper feed drive roller 20 and the paper feed follower roller 21, is conveyed past a printing position defined by a top surface of the platen 16, passes between the discharge drive roller 22 and the discharge follower roller 23, and is fed towards the paper exit 6. The recording paper 13 is thus conveyed over the top surface of the platen 16 from a back of the printer 1 to the front. A surface of the recording paper 13 passing the printing position is then printed on by the print head 17. The recording paper 13 fed out from between the discharge drive roller 22 and the discharge follower roller 23 is cut widthwise by a cutter mechanism 25 disposed near the paper exit 6.

The cutter mechanism 25 includes a fixed knife 25*a* disposed to a front connecting plate 35 described below, and a movable knife 25*b* disposed to a platen unit 30. The recording paper 13 is conveyed between the fixed knife 25*a* and the movable knife 25*b*, and is cut by the movable knife 25*b* moving towards the fixed knife 25*a*. A recording paper slip (not shown in the figures) that is cut off is removed from the paper exit 6 of the printer 1 and issued as a receipt, for example.

Platen Unit

As shown in FIG. 4, the platen 16, the paper feed follower roller 21, the discharge drive roller 22, and the movable knife 25*b* and movable knife drive mechanism of the cutter mechanism 25 are mounted on a platen frame 26 and move in unison as the platen unit 30.

The tension roller 15 is mounted on a back end of the platen unit 30, and the discharge guide 5 is attached to a front end of the platen unit 30. The platen unit 30 is normally positioned where the platen 16 defines the printing position of the print head 17, that is, in the closed position 30A shown in FIG. 3.

When the operating tab 5*a* of the discharge guide 5 is pulled forward, a lock (not shown in the figures) disengages, and the platen unit 30 can be pulled out to the open position 30B shown in FIG. 4. The platen unit 30 is pulled out along a straight first path of movement S1 from the closed position 30A to the front of the printer 1, and then travels forward and down along a curved second path of movement S2 to the open position 30B.

The cover 4 is attached to a cover mounting frame 46 connected to the platen unit 30, and opens to the front in conjunction with movement of the platen unit 30 from the closed position 30A to the open position 30B. The roll paper tray 11 of the roll paper compartment 7 also pivots to a position that is tilted a specific angle to the front of the printer 1 as shown in FIG. 4.

Main Frame

Figure 5:
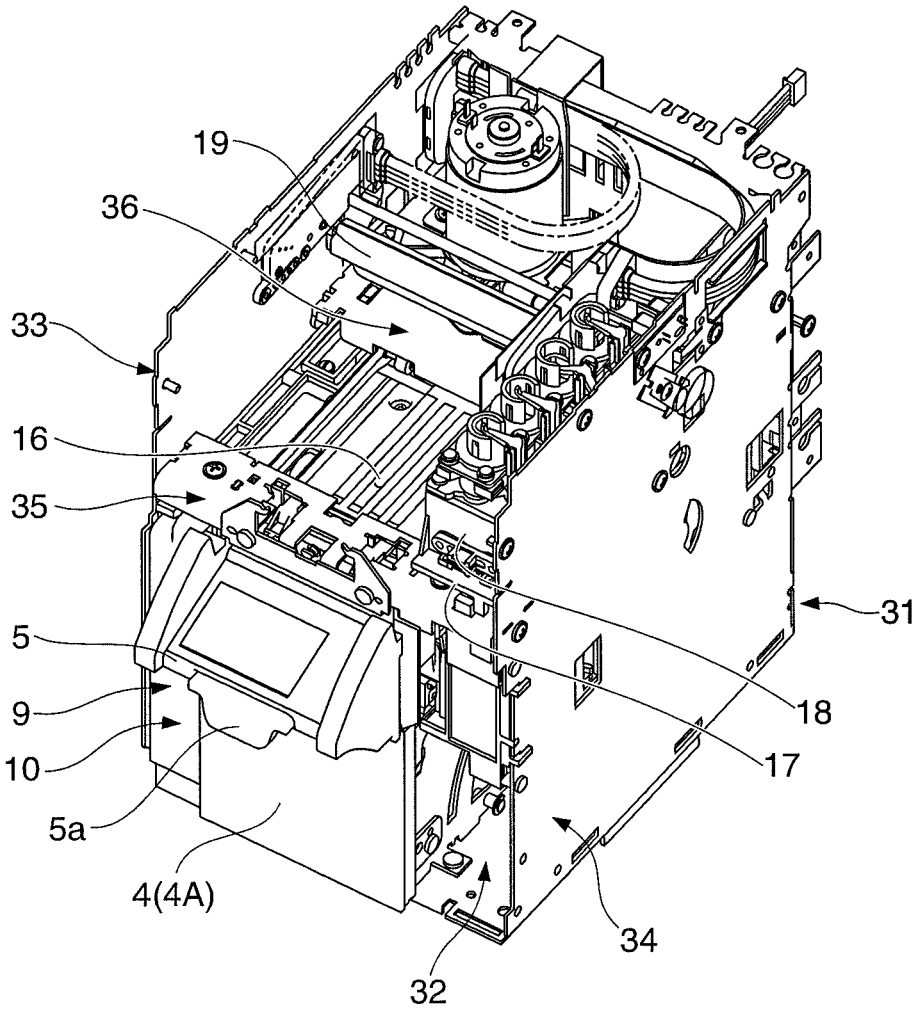
FIG. 5 is an oblique view showing a print mechanism unit of the roll paper printer of FIG. 1.

As shown in FIG. 5, a main frame 31 of the printer 1 is made of sheet metal and includes a bottom panel 32 and left and right side panels 33 and 34. A front connecting plate 35 and a rear connecting plate 36 span between front and back ends, respectively, of the left and right side panels 33 and 34 widthwise to the printer 1.

Figure 6A:
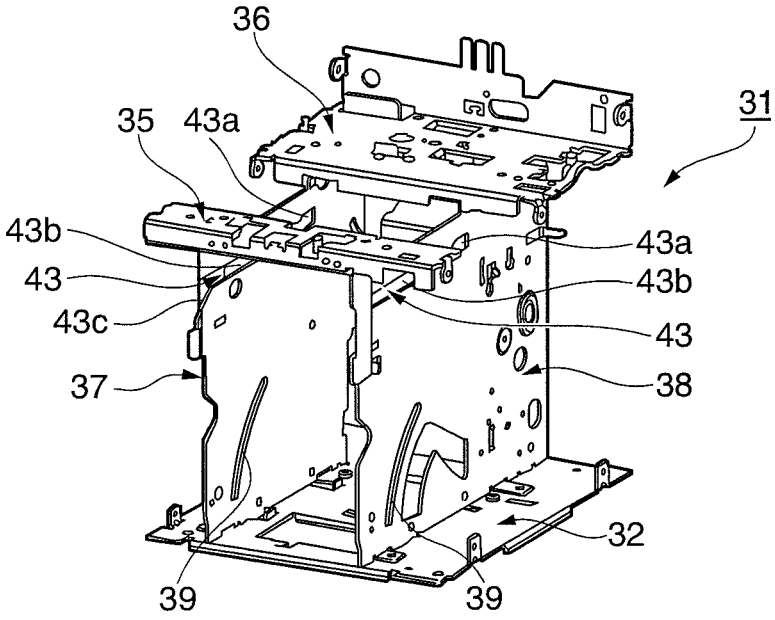
FIG. 6A is an oblique view showing a main frame of the roll paper printer of FIG. 1.
Figure 6B:
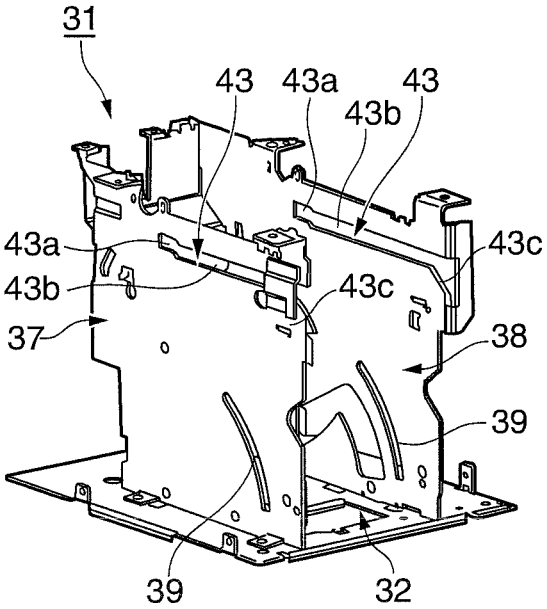
FIG. 6B is another oblique view showing the main frame of the roll paper printer. printer of FIG. 1.
Figure 6C:
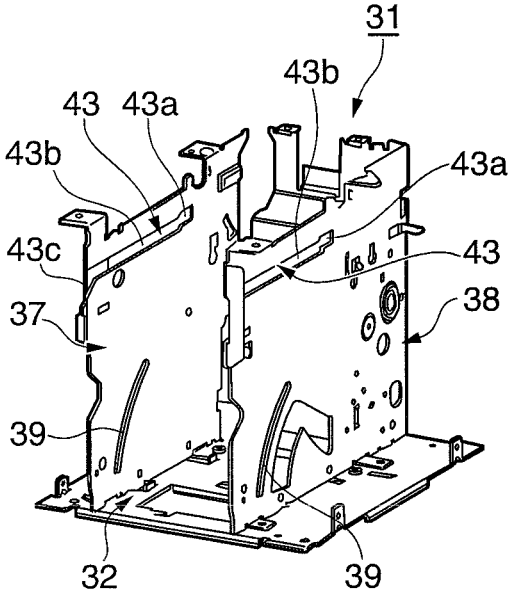
FIG. 6C is yet another oblique view showing the main frame of the roll paper printer. printer of FIG. 1.

FIG. 6A is an oblique view showing the main frame 31 without the left and right side panels 33 and 34. FIG. 6B and FIG. 6C are left and right side oblique views showing the main frame 31 without the front and rear connecting plates 35 and 36. As shown in these figures, the main frame 31 has left and right inside side panels 37, 38 on the inside of the left and right side panels 33 and 34, and the roll paper compartment 7 (see FIG. 2) is rendered between these inside side panels 37, 38.

Platen Support Mechanism

A platen support mechanism that supports the platen unit 30 movably with the cover 4 from the closed position 30A to the open position 30B is described next. The platen support mechanism is constructed around a six joint parallel linkage mechanism 42 (also called "a six joint linkage mechanism").

Figure 7A:
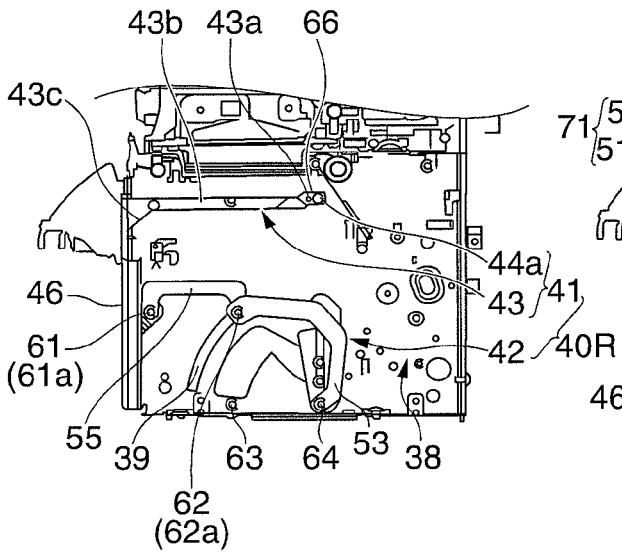
FIG. 7A is a right side view showing a platen support mechanism of the roll paper printer of FIG. 1.
Figure 7B:
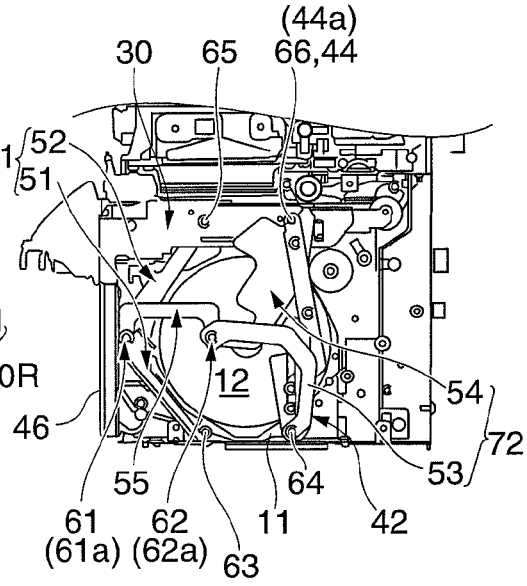
FIG. 7B is another right side view showing the platen support mechanism of the roll paper printer of FIG. 1.
Figure 7C:
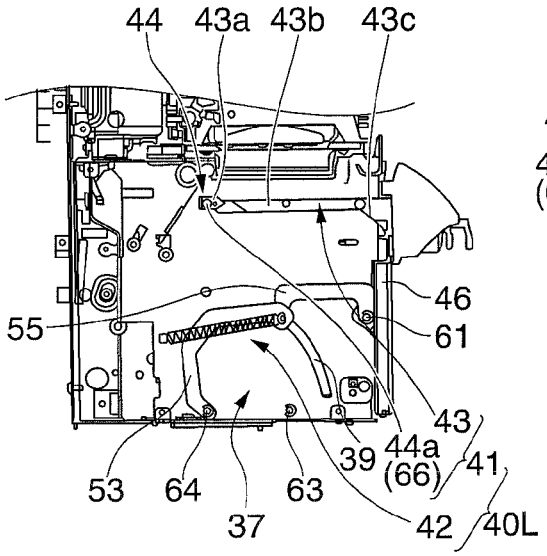
FIG. 7C is a left side view showing the platen support mechanism of the roll paper printer of FIG. 1.
Figure 7D:
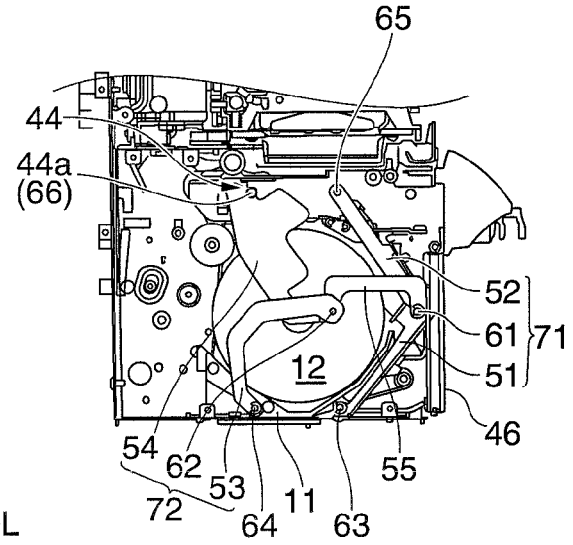
FIG. 7D is another left side view showing the platen support mechanism of the roll paper printer of FIG. 1.

FIG. 7A is a right side view from outside of the inside side panel 38 on a right side of the main frame 31, and FIG. 7B is a right side view of the main frame 31 when the inside side panel 38 is removed. FIG. 7C is a left side view from outside of the left inside side panel 37, and FIG. 7D is a left side view when the inside side panel 37 is removed.

Referring to these figures, the platen support mechanism has a right-side platen support mechanism 40R disposed on a side of the right inside side panel 38, and a left-side platen support mechanism 40L disposed on a side of the left inside side panel 37. The right-side platen support mechanism 40R and the left-side platen support mechanism 40L are symmetrical left and right (plane symmetric), and their construction is basically the same.

The right-side platen support mechanism 40R has a guide mechanism 41 and the six joint linkage mechanism 42. The guide mechanism 41 guides the platen unit 30 to an intermediate position from the closed position 30A to the open position 30B along the first path S1. The six joint linkage mechanism 42 holds the platen unit 30 in a specific posture as it is guided along the first path S1, and moves and holds the platen unit 30 in a specific posture along the curved second path S2 from the intermediate position to the open position 30B.

Guide Mechanism

The guide mechanism 41 has a guide channel 43 for guiding the platen unit 30 from the closed position 30A along the straight first path S1 toward the front of the printer 1.

The guide channel 43 is a channel formed by cutting a channel of a specific width and length in the right inside side panel 38 from a front end thereof towards the back of the printer 1. The guide channel 43 includes a straight guide channel part 43*b* extending horizontally, a positioning guide channel part 43*a* contiguous to a back end of and slightly above the guide channel part 43*b*, and a curved inclined guide surface 43*c* disposed to a front end of the guide channel part 43*b* and sloping down contiguously to a bottom guide surface of guide channel part 43*b*.

The guide mechanism 41 has a support rod 44 extending widthwise to the printer 1 at a position behind the platen unit 30. The end 44*a* of the support rod 44 protrudes widthwise to the printer 1 from the platen unit 30, and is inserted slidably along the guide channel 43 formed in the inside side panel 38. The platen unit 30 can thus move along the guide channel 43.

Note that a configuration in which the guide channel (or guide recess) is rendered on the platen unit side, and the rod (or protrusion) is formed on the main frame side, could also be used.

Six Joint Linkage Mechanism

The six joint linkage mechanism 42 includes a first compound link 71 including a first link 51 and a second link 52 connected in series by a first pin joint 61, a second compound link 72 including a third link 53 and a fourth link 54 connected in series by a second pin joint 62, and a fifth link 55 connected to the first pin joint 61 of the first compound link 71 and the second pin joint 62 of the second compound link 72.

A bottom end of the first compound link 71 and a bottom end of the second compound link 72 are connected to a third pin joint 63 and a fourth pin joint 64 at specific front and back positions separated a specific distance when seen along a front-back direction of the printer 1 (the direction in which the platen unit 30 opens). The third and fourth pin joints 63, 64 are determined by a support rod extending widthwise to the printer 1 and attached to the inside side panel 38 or the bottom panel 32.

A top end of the first compound link 71 and a top end of the second compound link 72 are similarly connected to a fifth pin joint 65 and a sixth pin joint 66 disposed at places on a side of the platen unit 30 separated a specific distance in the front-back direction of the printer 1. The rear sixth pin joint 66 is determined by the end 44*a* of the support rod 44 that can slide along the guide channel 43.

The six joint linkage mechanism 42 is thus rendered by the first to fifth links 51, 52, 53, 54, 55, and first to sixth pin joints 61, 62, 63, 64, 65, 66. More specifically, a length of a line segment connecting the first pin joint 61 and the second pin joint 62, a length of a line segment connecting the third pin joint 63 and the fourth pin joint 64, and a length of a line segment connecting the fifth pin joint 65 and the sixth pin joint 66 are equal; a length of a line segment connecting the first pin joint 61 and the third pin joint 63, and a length of a line segment connecting the second pin joint 62 and the fourth pin joint 64 are equal; and a length of a line segment connecting the first pin joint 61 and the fifth pin joint 65, and a length of a line segment connecting the second pin joint 62 and the sixth pin joint 66, are equal. In addition, the line segments connecting the first pin joint 61 and second pin joint 62, the third pin joint 63 and the fourth pin joint 64, and the fifth pin joint 65 and sixth pin joint 66 are parallel. The six joint parallel linkage mechanism 42 is thus rendered.

When the platen unit 30 is in the closed position 30A, the first and second compound links 71, 72 of the six joint linkage mechanism 42 are curved toward the front. More specifically, the first compound link 71 is curved with the first pin joint 61 that is the connection between the first link 51 and second link 52 of the first compound link 71 positioned closer to the front of the printer 1 than the third and fifth pin joints 63, 65. Likewise, the second compound link 72 is curved with the second pin joint 62 where the third link 53 and the fourth link 54 of the second compound link 72 are connected together positioned closer to the front of the printer 1 than the fourth and sixth pin joints 64, 66.

The curved front first compound link 71 and the rear second compound link 72 are connected together by the fifth link 55. Therefore, when the platen unit 30 slides forward guided by the guide channel 43, that is, while the elevation (height) of the sixth pin joint 66 (end 44*a*) of the six joint linkage mechanism 42 is determined by the guide channel 43, the platen unit 30 slides forward while its posture is held constant.

As the platen unit 30 slides forward, the first and second compound links 71, 72 gradually extend from the curved position. More specifically, the first and second compound links 71, 72 are configured so that they are extended when the end 44*a* of the support rod 44 that determines the sixth pin joint 66 at the top end of the second compound link 72 moves from the end of the straight guide channel part 43*b* of the guide channel 43 to the inclined guide surface 43*c* (at the intermediate position between the closed position 30A and the open position 30B).

A link length of the first and second compound links 71, 72, that is, the length when fully extended from the curved position, is the same. In other words, a maximum distance between the top and bottom fifth pin joint 65 and third pin joint 63 of the first compound link 71 when the first compound link 71 is extended (the length of the line segment connecting the third pin joint (contact point) 63 and the fifth pin joint (contact point) 65 when the first, third, and fifth contact points 61, 63, 65 are positioned on the same line), and a maximum distance between the top and bottom sixth pin joint 66 and fourth pin joint 64 of the second compound link 72 when the second compound link 72 is extended (the length of the line segment connecting the fourth pin joint (contact point) 64 and the sixth pin joint (contact point) 66 when the second, fourth, and sixth contact points 62, 64, 66 are positioned on the same line), are equal.

The first compound link 71 is configured so that when fully extended the first link 51 and the second link 52 are mutually engaged and cannot curve in the opposite direction (to the back). Therefore, after the first and second compound links 71, 72 are extended, the six joint linkage mechanism 42 functions as a four joint parallel linkage mechanism. As a result, the platen unit 30 thereafter moves along the curved second path S2 defined by the linkage length of the first and second compound links 71, 72 to the open position 30B while held in a constant posture.

As shown in FIG. 7C and FIG. 7D, the left-side platen support mechanism 40L is configured identically (that is, is plane symmetric) to the right-side platen support mechanism 40R. The same reference numerals used on the right-side platen support mechanism 40R are therefore assigned to the corresponding parts of the left-side platen support mechanism 40L, and further description thereof is omitted.

Note that shapes of the left and right first to fifth links 51, 52, 53, 54, 55 do not need to be the same, but the positions of the first to sixth pin joints 61, 62, 63, 64, 65, 66 must be symmetric.

Relative Positions of the Links to the Inside Side Panels 37, 38

As shown in FIG. 7A and FIG. 7B, in the six joint linkage mechanism 42 on the right side, the third and fifth links 53, 55 are disposed along an outside surface, and the first, second, and fourth link 51, 52, 54 are disposed along an inside surface, of the inside side panel 38. The second pin joint 62 between the outside third and fifth links 53, 55 and the inside fourth link 54 is defined by a support pin 62*a* extending widthwise to the printer 1. A curved channel 39 is formed in the inside side panel 38 along a path of support pin 62*a* movement. The support pin 62*a* is fit slidably in the curved channel 39. The first pin joint 61 between the first and second links 51, 52 on the inside and the fifth link 55 is defined by a support pin 61*a* disposed on a front outside side of the inside side panel 38 extending widthwise to the printer 1. Because the first to fifth links 51, 52, 53, 54 55 are thus disposed with the inside side panel 38 therebetween, sideways deflection of the six joint linkage mechanism 42 widthwise to the printer 1 and chatter can be suppressed by the inside side panel 38.

The links of the six joint linkage mechanism 42 on the left side are identically configured as shown in FIG. 7C and FIG. 7D, like reference numerals are assigned to like parts, and further description thereof is omitted.

The cover mounting frame 46 spans between a bottom front end of the platen unit 30 and bottom parts of the left and right inside side panels 37, 38. As shown in FIG. 3 and FIG. 4, the cover mounting frame 46 includes a bottom frame member 46*a* attached to the left and right inside side panel 37, 38 side, and a top frame member 46*b* attached to the platen unit 30 side. The cover 4 is attached to a front of the top frame member 46*b*. The bottom frame member 46*a* and the top frame member 46*b* are connected slidably to each other, and expand and contract with opening and closing of the cover 4 (platen unit 30).

Opening and Closing the Platen Unit

Figure 8B:
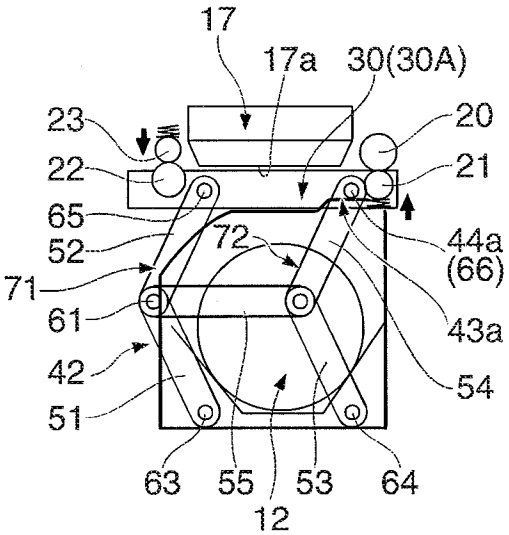
FIG. 8B is a schematic view showing the platen support mechanism of FIG. 8A.
Figure 8A:
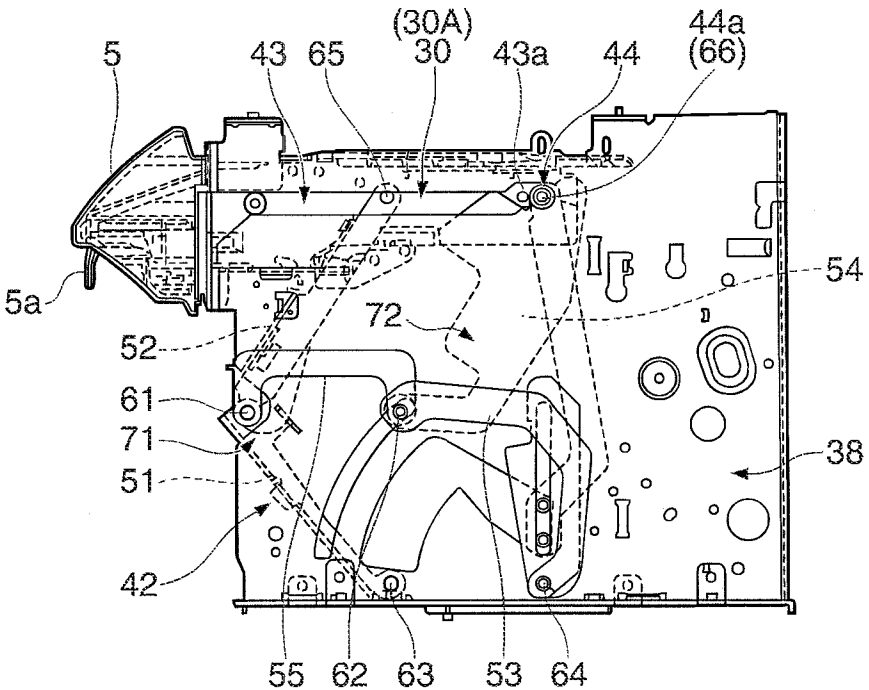
FIG. 8A is a side view showing the platen support mechanism of the roll paper printer of FIG. 1 in a closed position.

FIG. 8A shows the platen unit 30 in the closed position 30A, and FIG. 8B schematically describes, the platen support mechanism in the closed position 30A. In the closed position 30A, the end 44*a* of the support rod 44 attached to the back side of the platen unit 30 is positioned in the positioning guide channel part 43*a* at the back end of the guide channel 43. The paper feed follower roller 21 and the discharge drive roller 22 mounted on the platen unit 30 are pressed to the paper feed drive roller 20 and the discharge follower roller 23 on the main frame 31 side. The platen 16 mounted on the platen unit 30 is positioned to a position opposite the nozzle surface 17*a* of the print head 17 with a specific gap therebetween. The front and back compound links 71, 72 of the six joint linkage mechanism 42 are curved forward and the linkage length is contracted.

When the operating tab 5*a* attached to the front of the platen unit 30 is pulled forward so that the lock is released and the operating tab 5*a* is then pulled further forward, the platen unit 30 is pulled along the guide channel 43 to the printer front. When the rod end 44*a* of the platen unit 30 moves from the back positioning guide channel part 43*a* to the lower straight guide channel part 43*b*, the complete platen unit 30 descends, and the paper feed follower roller 21 and the discharge drive roller 22 move down and away from the paper feed drive roller 20 and the discharge follower roller 23 on the main frame 31 side.

Figure 9B:
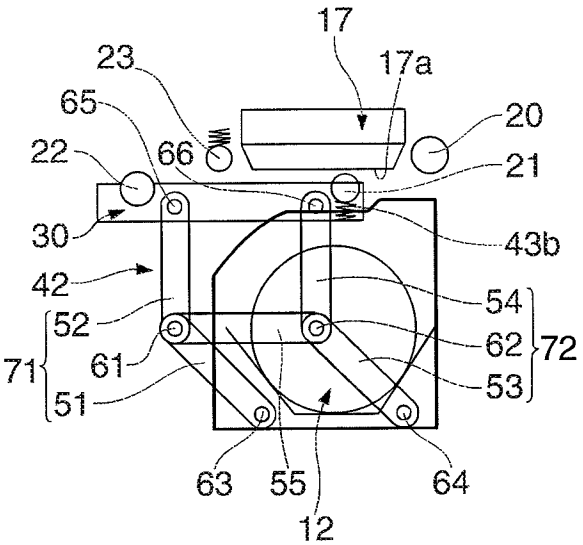
FIG. 9B is a schematic view showing the platen support mechanism of FIG. 9A.
Figure 9A:
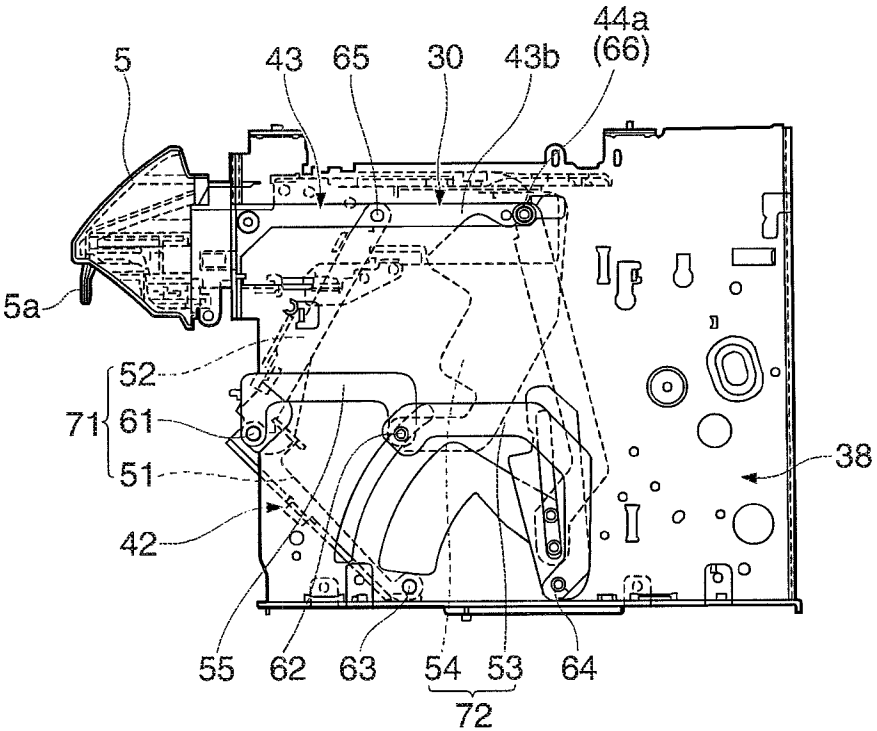
FIG. 9A is a side view showing the platen support mechanism of the roll paper printer of FIG. 1 when the platen support mechanism begins to open.

FIG. 9A shows, and FIG. 9B schematically describes, the platen unit 30 in this position.

Because the platen unit 30 moves forward along the straight guide channel part 43*b* while held in a constant posture by the six joint linkage mechanism 42, the platen unit 30 moves forward without interference with other parts disposed above the platen unit 30 on the main frame 31 side. The platen unit 30 is also configured so that it is pulled forward without interference with the roll paper 12 stored below the platen unit 30.

The platen unit 30 is thus pulled out in a straight line towards an operating direction of an operating force applied to the operating tab 5*a* at the front. Because a platen unit moves on a curved path when the platen unit is supported by a four joint parallel linkage mechanism, the direction of the operating force and the direction of platen unit movement are not the same, and the platen unit cannot be pulled out smoothly. In this embodiment of the invention, however, the platen unit 30 can be pulled out smoothly with little operating force along the straight guide channel part 43*b* without being constrained by the linkage mechanism (that is, because the linkage mechanism can expand and contract).

Furthermore, while the platen unit 30 is pulled out along a straight first path S1 (such as the path of the sixth pin joint 66) in this embodiment of the invention, because this first path S1 is not limited by the six joint linkage mechanism 42 (that is, because the linkage mechanism is not a fixed length), the first path S1 is not limited to a straight path insofar as there are no problems with operability, and the platen unit 30 can be pulled along may be a curved, stepped, or other desirable path in which the compound links 71, 72 can expand and contract.

Figure 10:
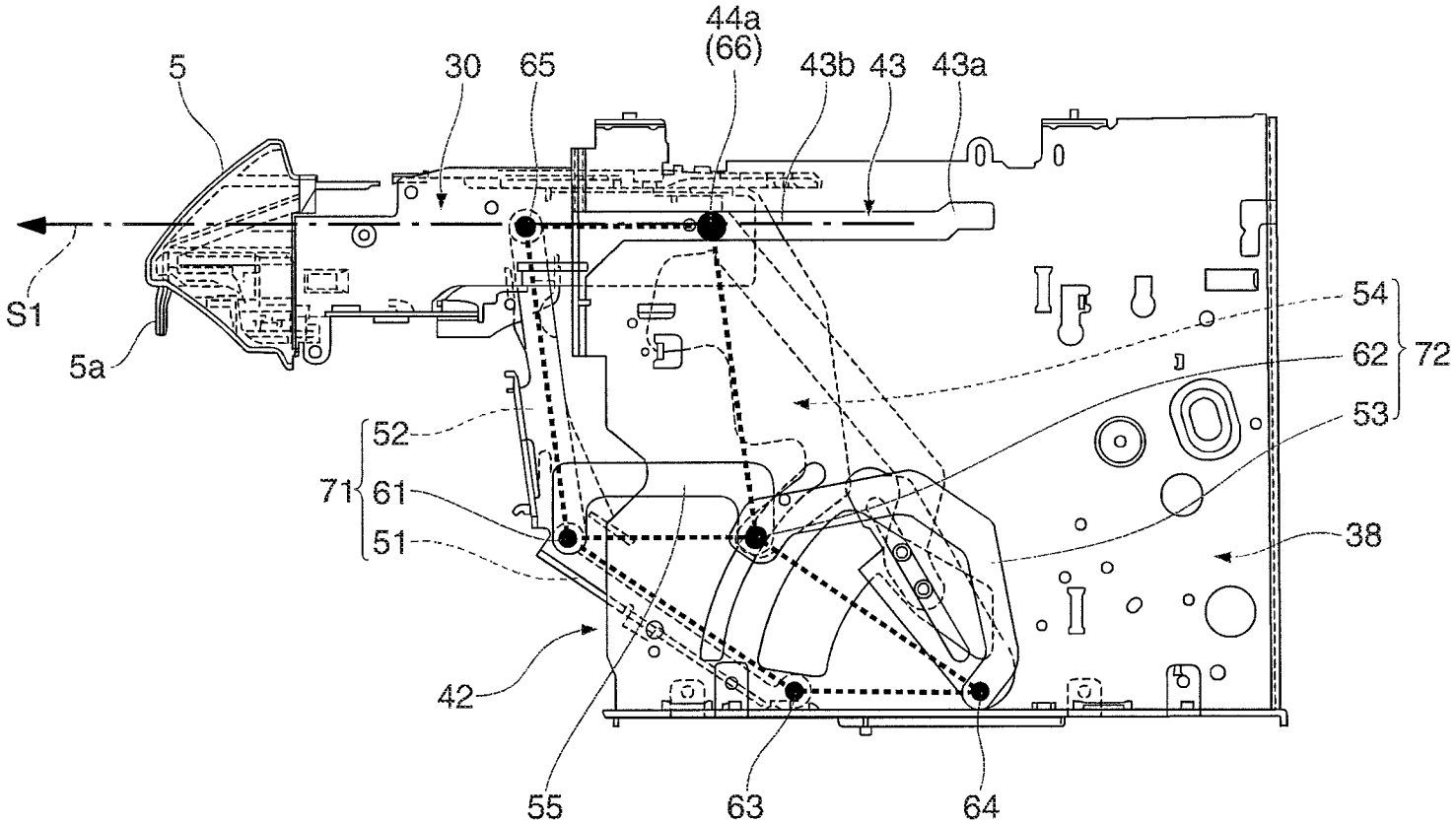
FIG. 10 is a side view showing the platen support mechanism of the roll paper printer of FIG. 1 when opened to just before a midpoint position.

As shown in FIG. 10, as the platen unit 30 is pulled forward, the first and second compound links 71, 72 gradually extend from the curved position. As described above, when the end 44*a* of the support rod 44 on the back side of the platen unit 30 reaches the front end of the straight guide channel part 43*b* of the guide channel 43 (that is, the back end of the inclined guide surface 43*c*), the first and second compound links 71, 72 are fully extended to the maximum linkage length.

Figure 11B:
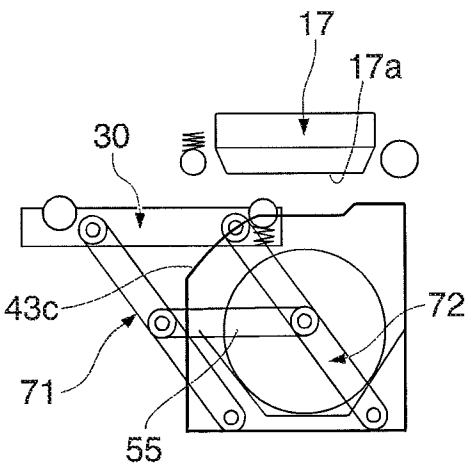
FIG. 11B is a schematic view showing the platen support mechanism of FIG. 11A.
Figure 11A:
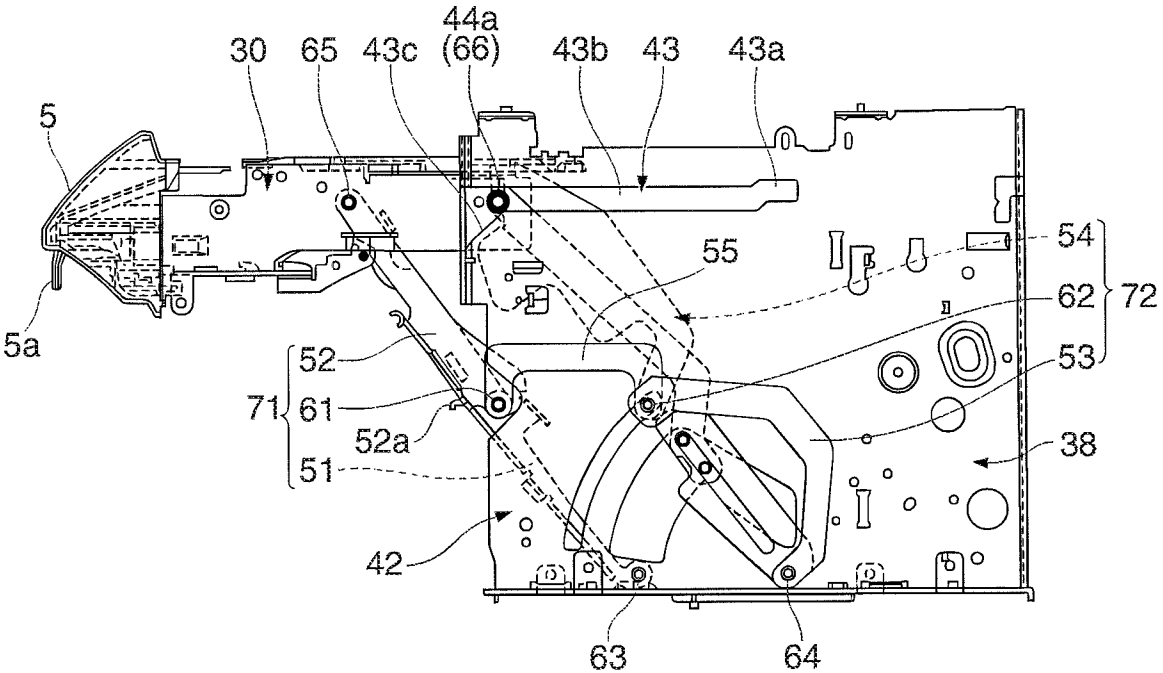
FIG. 11A is a side view showing the platen support mechanism of the roll paper printer of FIG. 1 when opened to the midpoint position.

FIG. 11A shows, and FIG. 11B schematically describes, the platen unit 30 in this position. The platen unit 30 moves forward along the straight first path S1 until the end 44*a* moves from the front end of the straight guide channel part 43*b* to the inclined guide surface 43*c*.

In this position a four joint parallel linkage mechanism is rendered by the fully extended first and second compound links 71, 72. More specifically, the top end of the first link 51 contacts a stop 52*a* formed on the bottom end of the second link 52, and the first compound link 71 is held fully extended. The second compound link 72 linked to the first compound link 71 by the fifth link 55 is also held fully extended, rendering a four joint parallel linkage mechanism with joints at the third to sixth pin joints 63, 64, 65, 66.

The platen unit 30 is then pulled to the forward open position 30B while held in the same posture along the curved second path S2 (such as the path drawn by the sixth pin joint 66) defined by the first and second compound links 71, 72 that function as a four joint parallel linkage mechanism.

Note that the third link 53 and the fourth link 54 of the second compound link 72 could be engaged with each other so that they do not curve to the opposite side (back side).

Figure 12B:
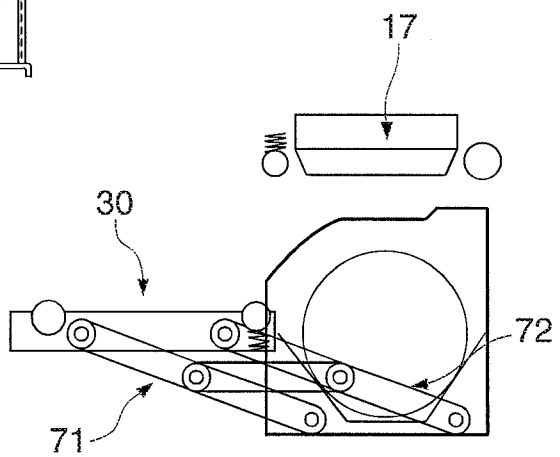
FIG. 12B is a schematic view showing the platen support mechanism of FIG. 12A.
Figure 12A:
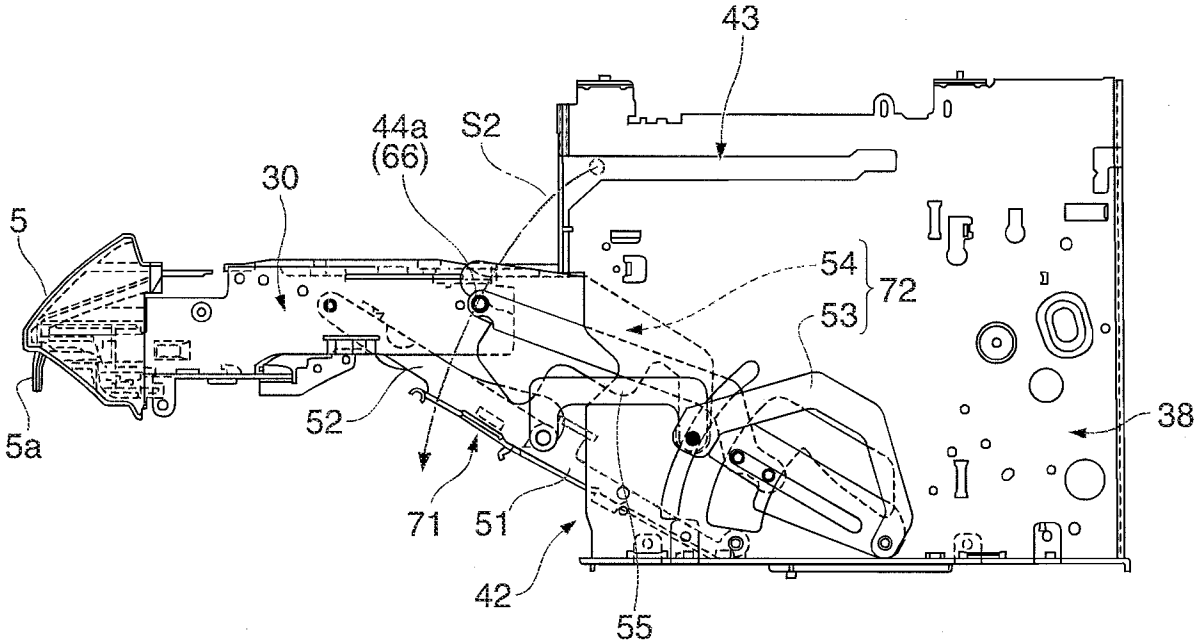
FIG. 12A is a side view showing the platen support mechanism of the roll paper printer of FIG. 1 when opened to just before an open position.

FIG. 12A shows, and FIG. 12B schematically describes, when the platen unit 30 is moved forward when the six joint linkage mechanism 42 functions as a four joint parallel linkage mechanism. Because the first and second compound links 71, 72 pivot forward when fully extended (to the maximum link length), the platen unit 30 moves forward along the curved second path S2 with a large radius of curvature. The platen unit 30 can therefore be pulled to the forward open position 30B without interference with the roll paper 12, for example, located therebelow.

Figure 13:
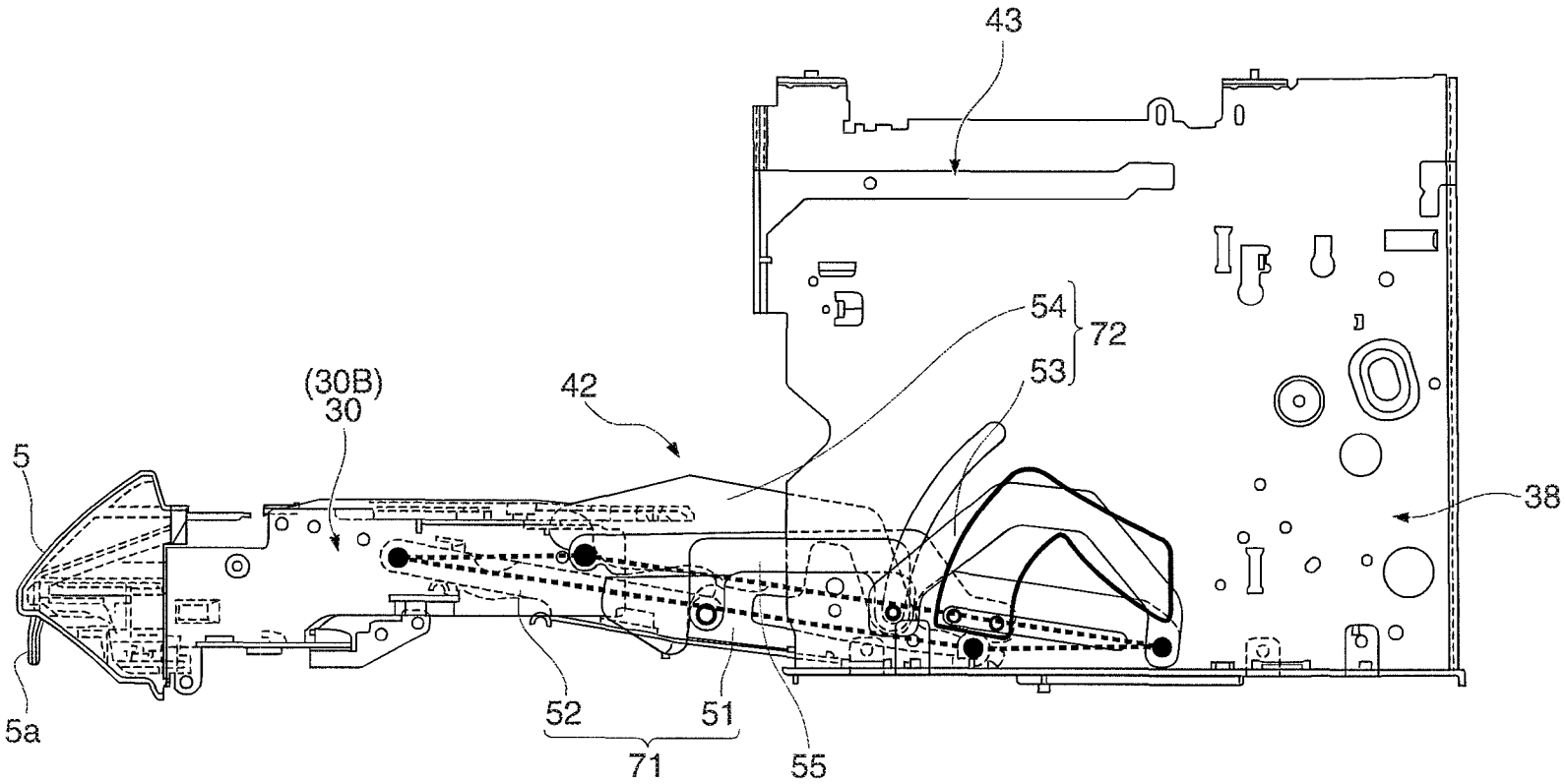
FIG. 13 is a side view showing the platen support mechanism of the roll paper printer of FIG. 1 in the open position.

FIG. 13 shows the platen unit 30 when pulled out to the open position 30B.

Loading Roll Paper

The above operation is reversed to return the platen unit 30 from the open position 30B to the closed position 30A. Even if the roll paper 12 is not stored suitably in the roll paper compartment 7 when the platen unit 30 is returned from the open position 30B to the closed position 30A, the roll paper 12 can be appropriately set in the roll paper compartment 7 because the roll paper 12 is pushed to the back of the printer 1 by the movement of the first compound link 71 of the six joint linkage mechanism 42.

More specifically, as described above, the first compound link 71 is disposed along the inside surfaces of the left and right inside side panels 37, 38 of the main frame 31, and is positioned on the inside of end faces of the roll paper 12 stored in the roll paper compartment 7. When the platen unit 30 is in the closed position 30A (the cover 4 is in the closed position 4A), the first compound link 71 curves to the front, the bottom first link 51 is sloped along the bottom half of the curved part in front of the roll paper 12, and the top second link 52 is sloped along the top half of the curved part in front of the roll paper 12.

Therefore, if the roll paper 12 is not inserted all the way into the roll paper compartment 7, the first and second links 51, 52 of the first compound link 71 contact both ends of the roll paper 12 from the front when the platen unit 30 closes and push the roll paper 12 in. Because the roll paper 12 is thus automatically stored in the specified storage position, the six joint linkage mechanism 42 also has the effect of preventing the roll paper 12 from being improperly loaded.

This embodiment of the invention renders a six joint linkage mechanism 42 using front and back first and second compound links 71, 72 that can expand and contract (can fold), and when the platen unit 30 is in the closed position 30A, little space is needed between the platen unit 30 and the roll paper 12 stored in the roll paper compartment 7 as shown in FIG. 7B and FIG. 7D. More particularly, a gap between the platen unit 30 and the roll paper 12 is small after new unused roll paper 12 is loaded. In addition, the first and second links 51, 52 of the front first compound link 71 are disposed along the curvature of the roll paper 12 at the front of the roll paper 12, a gap therebetween is narrow, and when the roll paper 12 moves forward both ends thereof contact the first and second links 51, 52.

Therefore, the platen unit 30 is disposed opposite the top and the first compound link 71 is disposed opposite the front of the roll paper 12 stored in the roll paper compartment 7 with a narrow gap therebetween. As a result, because there is substantially no movement of the roll paper 12 when the roll paper 12 is loaded in the roll paper compartment 7 even if the printer 1 is turned upside down, a roll paper holding effect that can hold the roll paper 12 stable in the roll paper compartment 7 is also achieved.

Platen Unit Posture Holding Mechanism

When the end 44*a* of the support rod 44 of the platen unit 30 separates from the guide channel 43 to the front with the six joint linkage mechanism 42 according to this embodiment of the invention, the posture of the links in the six joint linkage mechanism 42 becomes more unstable than to that point. As a result, the posture of the platen unit 30 can shift vertically as it moves along the second path S2.

When the platen unit 30 is shifted vertically and returns from the open position 30B along the curved second path S2, the end 44*a* of the support rod 44 of the platen unit 30 goes to an elevation shifted vertically from the guide channel 43 on the main frame 31 side, the end 44*a* collides with the side of the main frame 31, and the operation that returns the platen unit 30 may not be smooth. For example, if the first and second compound links 71, 72 curve from the fully extended state on the second path S2 when the platen unit 30 closes, the height of the end 44*a* (the sixth pin joint 66) drops and the end 44*a* will contact the inside side panels 37, 38 below the guide channel 43.

To solve this problem and enable the platen unit 30 to return smoothly to the closed position 30A, a mechanism that holds the first and second compound links 71, 72 in the fully extended state while moving through the second path S2 can be provided.

The platen support mechanism according to this embodiment of the invention therefore has a support mechanism that holds the compound links 71, 72 in a fully extended state while the platen unit 30 moves along the second path S2. The support mechanism holds a maximum gap between the third pin joint 63 and fifth pin joint 65 of the first compound link 71, and the fourth pin joint 64 and sixth pin joint 66.

FIG. 14A to FIG. 14D describe a first holding mechanism attached to the left-side platen support mechanism 40L.

Figure 14A:
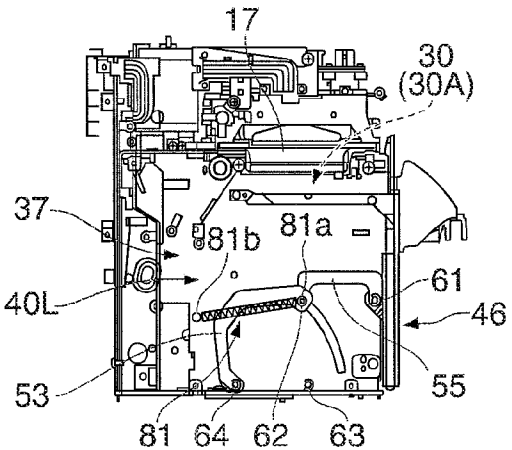
FIG. 14A is a side view showing a first holding mechanism attached to the platen support mechanism of the roll paper printer of FIG. 1 when in a closed position.

As shown in FIG. 14A, the first holding mechanism has a tension spring 81. One end 81*a* of the tension spring 81 is connected to the second pin joint 62 of the second compound link 72, and its other end 81*b* is connected to a part of the inside side panel 37 at the back side of the printer 1. By appropriately setting where the tension spring 81 is attached and by appropriately setting its length, the extension of the tension spring 81 can be zero while the platen unit 30 is on the first path S1, and the tension spring 81 can stretch while the platen unit 30 is on the second path S2.

Figure 14B:
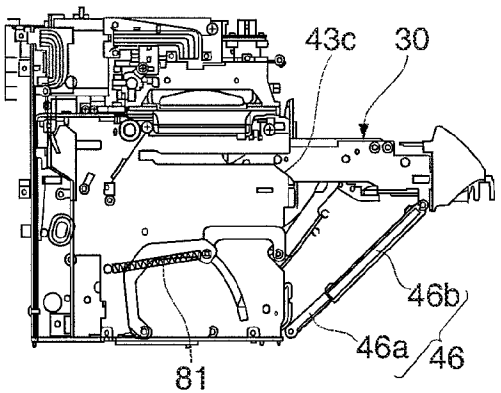
FIG. 14B is a side view showing the first holding mechanism attached to the platen support mechanism of the roll paper printer of FIG. 1 when in an intermediate position.
Figure 14C:
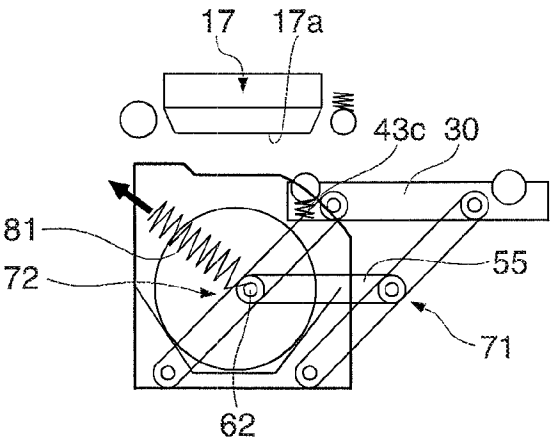
FIG. 14C is a schematic view showing the first holding mechanism attached to the platen support mechanism of FIG. 14B.

The tension spring 81 therefore does not stretch while the platen unit 30 in the closed position 30A, shown in FIG. 14A, is pulled out in a straight line to the front end of the first path S1 (the intermediate position), as shown in FIG. 14B.

As the platen unit 30 is pulled forward from this position, the tension spring 81 stretches and the second pin joint 62 of the second compound link 72 is pulled to toward the back of the printer 1. A force towards the back of the printer 1 also works on the first pin joint 61 connected to the second pin joint 62 due to the fifth link 55. As a result, the top of the first link 51 and the bottom of the second link 52 contact, and the first compound link 71 is held in a fully extended position. Because the first and second compound links 71, 72 at the front and back are held in the fully extended position while in the second path S2, the platen unit 30 is held in a constant posture and does not shift vertically. This is shown schematically in FIG. 14C.

Figure 14D:
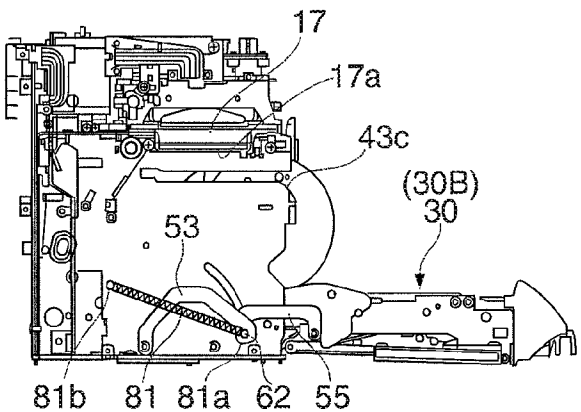
FIG. 14D is a side view showing the first holding mechanism attached to the platen support mechanism of the roll paper printer of FIG. 1 when in an open position.

As a result, when the platen unit 30 is returned from the open position 30B to the closed position 30A, the end 44*a* of the support rod 44 of the paper feed drive roller 20 is inserted smoothly to the guide channel 43, and the platen unit 30 can be returned smoothly. In addition, because the tension spring 81 is stretched when the platen unit 30 is in the open position 30B, as shown in FIG. 14D, and a force returning the platen unit 30 to the closed position 30A works on the left-side platen support mechanism 40L, the platen unit 30 can be returned with little force.

With the first holding mechanism that holds the first and second compound links 71, 72 in the fully extended state by means of a spring, the first and second compound links 71, 72 can become unstable, and the posture of the platen unit 30 can vary when a strong external force is applied momentarily. The platen support mechanism according to this embodiment of the invention therefore also has a second holding mechanism disposed to the right-side platen support mechanism 40R that holds the compound links 71, 72 fully extended by means of a mechanical engagement using an expansion link and a curved guide channel.

Figure 15A:
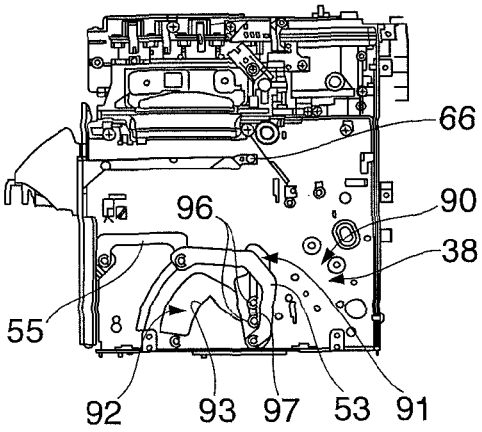
FIG. 15A is a side view showing a second holding mechanism of the roll paper printer of FIG. 1 when in the closed position.
Figure 15B:
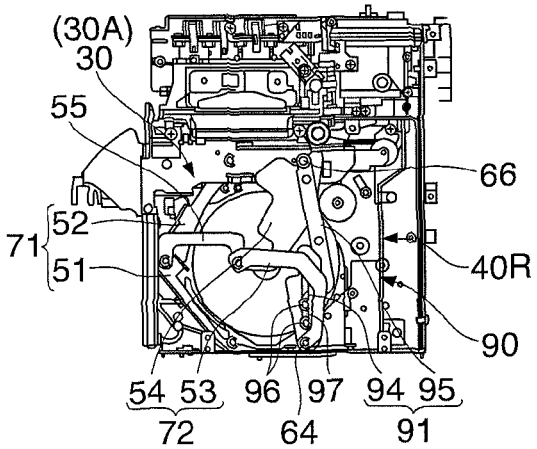
FIG. 15B is another side view showing the second holding mechanism of the roll paper printer of FIG. 1 when in the position of FIG. 15A.

As shown in FIG. 15A and FIG. 15B, a second holding mechanism 90 disposed to the right-side platen support mechanism 40R includes a sliding expansion link 91 disposed along the inside surface of the inside side panel 38, and a link guide channel 92 formed in the inside side panel 38. A bottom edge of the link guide channel 92 functions as a guide surface 93 for holding the sliding expansion link 91 extended.

The sliding expansion link 91 includes a straight fixed-side link 94 of which a bottom end is connected to the fourth pin joint 64 of the second compound link 72, and a slide-side link 95 of which a top end is connected to the sixth pin joint 66 of the second compound link 72. Two slide pins 96 are disposed to a bottom end of the slide-side link 95, and the slide pins 96 are slidably inserted to a slide channel 97 (slot) that is formed in and extends lengthwise to the fixed-side link 94. By providing two slide pins 96, the slide-side link 95 can be made to slide in a straight line in the direction in which the slide channel 97 extends.

Figure 15C:
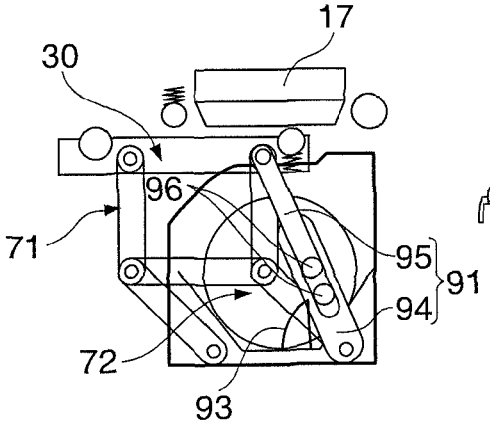
FIG. 15C is a schematic view showing the second holding mechanism of the roll paper printer of FIG. 1 when moved from the position of FIGS. 15A and 15B.

As the platen unit 30 moves from the closed position 30A along the first path S1 to the front end thereof, the sliding expansion link 91 also extends following the extension of the second compound link 72 as shown schematically in FIG. 15C.

Figure 15D:
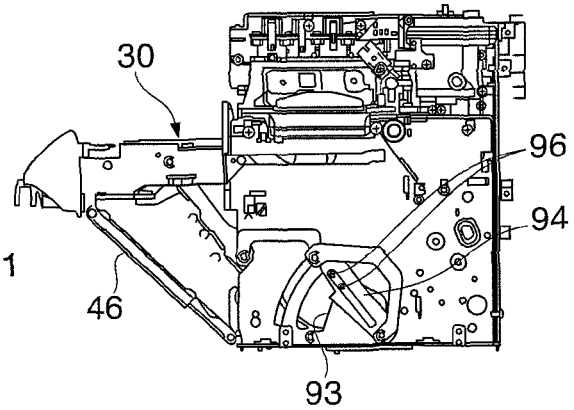
FIG. 15D is a side view showing the second holding mechanism of the roll paper printer of FIG. 1 when moved from the position of FIG. 15C.
Figure 15E:
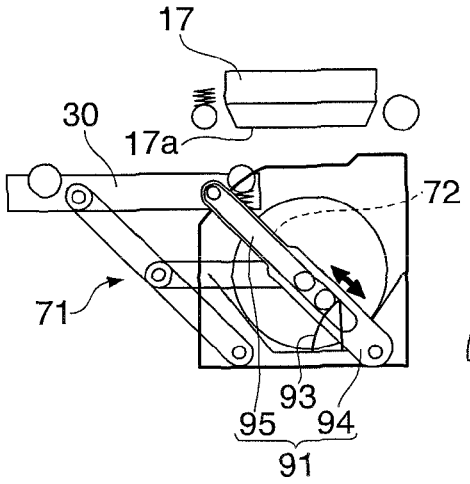
FIG. 15E is a schematic view showing the second holding mechanism of the roll paper printer of FIG. 1 when in the position of FIG. 15D.
Figure 15F:
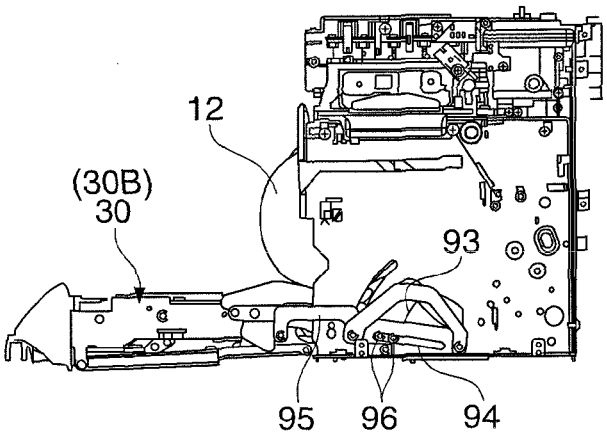
FIG. 15F is a side view showing the second holding mechanism of the roll paper printer of FIG. 1 when moved from the position of FIGS. 15D and 15E to an open position.

When the platen unit 30 moves from the first path S1 to the second path S2, the second compound link 72 becomes fully extended and the sliding expansion link 91 is maximally extended as shown in FIG. 15D. At this time the lower slide pin 96 rides onto the curved guide surface 93 that faces the front of the printer 1. As shown schematically in FIG. 15E, the sliding expansion link 91 then pivots with the slide pin 96 riding on the guide surface 93. The sliding expansion link 91 can thus pivot while fully extended by forming the guide surface 93 with a contour corresponding to a path of slide pin 96 movement when the extended sliding expansion link 91 pivots. More specifically, because the lower slide pin 96 of the slide-side link 95 is in contact with the guide surface 93 while the sliding expansion link 91 pivots, the length of the sliding expansion link 91 does not contract. Therefore, because the first and second compound links 71, 72 are held fully extended while in the second path S2, the platen unit 30 can be moved to the open position 30B, shown in FIG. 15F, while held stably in the same posture.

When the platen unit 30 is returned from the open position 30B to the closed position 30A, the compound links 71, 72 are returned through the second path S2 while held fully extended by the expansion link 91. The platen unit 30 is therefore held in a constant posture, and the end 44*a* of the support rod 44 smoothly enters the guide channel 43. As a result, the operation of returning the platen unit 30 is smooth. More specifically, because the posture of the platen unit 30 is held stable by the force of the tension spring 81 and the mechanical linkage of the sliding expansion link in this embodiment of the invention, the platen unit 30 can be opened and closed (the cover 4 can be opened and closed) with an extremely smooth action.

The platen support mechanism according to this embodiment of the invention has a first holding mechanism composed of a tension spring disposed on one side (the left-side platen support mechanism) and a second holding mechanism including a sliding expansion link disposed to the other side (the right-side platen support mechanism), but both the first holding mechanism and second holding mechanism could be disposed to either side. Further alternatively, the same holding mechanism, that is, either the first holding mechanism or the second holding mechanism, could be disposed on both sides. Yet further, when the platen unit is small, a configuration that has only one of the holding mechanisms disposed on only one side is also conceivable.

Yet further, the first holding mechanism may be disposed on the first compound link side. For example, the tension spring 81 can be connected between the first joint 61 of the first compound link 71 and the main frame 31. The second holding mechanism can likewise be disposed on the first compound link side. For example, the sliding expansion link 91 can be rendered by a fixed-side link of which one end is connected to the third pin joint 63, and a slide-side link of which one end is connected to the fifth pin joint 65.

Effect of the Platen Support Mechanism

The following operating effects are achieved by means of the platen support mechanism of the printer 1 according to the embodiment of the invention described above.

(1) Because the platen unit can be moved in a straight line and the platen unit can then be opened along a curved path of motion after avoiding the roll paper, less space is needed to avoid the roll paper than when using a platen support mechanism rendered by a four-joint parallel linkage mechanism. The invention is therefore useful for reducing the printer size.

(2) The height of the print mechanism unit does not need to be increased even when the platen unit is large because the platen unit can be moved in a straight line to a position where it does not contact the roll paper.

(3) Because the platen unit can be pulled out along a platen unit guide channel, the heightwise position of the platen unit can be easily controlled by the platen unit guide channel. For example, if there are parts that interfere with the platen unit when the platen unit is pulled out, they can be easily avoided by using the guide channel to change the path of movement.

(4) Because the operating tab that is used to pull the platen unit out is located at the front end of the platen unit, the platen unit can be pulled out smoothly because a bending moment is not produced on the platen unit when the platen unit is pulled out.

(5) Because the platen unit and the front compound link of the six joint linkage mechanism are disposed around the roll paper stored in the roll paper compartment with little space therebetween, movement of the roll paper is thereby limited. The stability of the roll paper stored in the roll paper compartment can therefore be improved.

(6) Because the front compound link of the six joint linkage mechanism supporting the platen unit pushes the roll paper into the roll paper compartment when the user closes the cover, that is, closes the platen unit, when the roll paper is not set appropriately in the roll paper compartment, roll paper can be automatically set appropriately in the roll paper compartment.

(7) Changes in the posture of the platen unit can be prevented and the platen unit can be opened and closed with a smooth action because a holding mechanism holds the front and back compound links of the six joint linkage mechanism fully extended.

OTHER EMBODIMENTS

The foregoing embodiment of the invention illustrated in FIGS. 1-15F applies the invention to a roll paper printer with a roll paper compartment. The platen support mechanism of the invention is not so limited, however, and can also be used in roll paper printers that do not have a roll paper compartment, as well as other types of printers having a platen unit that opens and closes in order to open and close a recording paper transportation path (such as printers that can print on fanfold paper).

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A printer platen support mechanism that supports a platen unit having a platen that defines a printing position of a print head so that the platen unit can move between a closed position where the platen defines the printing position and an open position separated from the closed position, comprising:

a guide mechanism that guides the platen unit to an intermediate position on a first path of movement between the closed position and the open position; and a six joint linkage mechanism that supports the platen unit guided along the first path of movement in a specific posture and causes the platen unit to move from the intermediate position to the open position along a curved second path of movement while held in a specific posture, the six joint linkage mechanism including a first compound link having a first link and a second link connected in series at a first pin joint, a second compound link having a third link and a fourth link connected in series at a second pin joint, and a fifth link connected between the first pin joint of the first compound link and the second pin joint of the second compound link;

wherein a first end of the first compound link and a first end of the second compound link are connected respectively to a third pin joint and a fourth pin joint at defined front and back positions with a specific distance therebetween when the platen unit is seen in a direction opening from the closed position to the open position;

a second end of the first compound link and a second end of the second compound link are connected respectively to a fifth pin joint and a sixth pin joint at defined front and back positions of the platen unit with a specific distance therebetween when seen in the opening direction;

when the platen unit is positioned above the first path of movement, a first gap between the third pin joint and the fifth pin joint, and a second gap between the fourth pin joint and the sixth pin joint, are less than respective maximum gaps therebetween, and when the platen unit moves from the first path of movement to the second path of movement, the first and second gaps increase to their respective maximum gaps;

the guide mechanism has a platen unit guide channel that defines the first path of movement, and a slide member that can slide along the platen unit guide channel;

the platen unit comprises a part of the platen unit guide channel and the slide member; and another part of the platen unit guide channel and the slide member are disposed on a side of a printer frame.

2. The printer platen support mechanism described in claim 1, wherein:

the platen unit has a shaft member that determines a pivot center of the sixth pin joint of the second compound link;

the slide member comprises end parts of the shaft member;

the printer frame has a frame part disposed opposite the end parts; and the platen unit guide channel is formed in each of the frame parts.

3. The printer platen support mechanism described in claim 1, further comprising:

a holding mechanism that, when the platen unit is on the second path of movement, holds the first gap between the third pin joint and the fifth pin joint, and the second gap between the fourth pin joint and the sixth pin joint, at the maximum gaps therebetween.

4. A printer platen support mechanism that supports a platen unit having a platen that defines a printing position of a print head so that the platen unit can move between a closed position where the platen defines the printing position and an open position separated from the closed position, comprising:

a guide mechanism that guides the platen unit to an intermediate position on a first path of movement between the closed position and the open position;

a six joint linkage mechanism that supports the platen unit guided along the first path of movement in a specific posture and causes the platen unit to move from the intermediate position to the open position along a curved second path of movement while held in a specific posture, six joint linkage mechanism including a first compound link having a first link and a second link connected in series at a first pin joint, a second compound link having a third link and a fourth link connected in series at a second pin joint, and a fifth link connected between the first pin joint of the first compound link and the second pin joint of the second compound link; and a holding mechanism, wherein a first end of the first compound link and a first end of the second compound link are connected respectively to a third pin joint and a fourth pin joint at defined front and back positions with a specific distance therebetween when the platen unit is seen in a direction opening from the closed position to the open position;

a second end of the first compound link and a second end of the second compound link are connected respectively to a fifth pin joint and a sixth pin joint at defined front and back positions of the platen unit with a specific distance therebetween when seen in the opening direction;

when the platen unit is positioned above the first path of movement, a first gap between the third pin joint and the fifth pin joint, and a second gap between the fourth pin joint and the sixth pin joint, are less than respective maximum gaps therebetween, and when the platen unit moves from the first path of movement to the second path of movement, the first and second gaps increase to their respective maximum gaps;

when the platen unit is on the second path of movement, the holding mechanism holds the first gap between the third pin joint and the fifth pin joint, and the second gap between the fourth pin joint and the sixth pin joint, at the maximum gaps therebetween;

the holding mechanism comprises a tension spring;

a first end of the tension spring is connected to the second pin joint of the second compound link;

a second end of the tension spring is connected to a part of the printer frame positioned to the back of the second pin joint when the platen unit is seen in the opening direction; and the tension spring is held in a specific extended state while the platen unit is on the second path of movement.

5. A printer platen support mechanism that supports a platen unit having a platen that defines a printing position of a print head so that the platen unit can move between a closed position where the platen defines the printing position and an open position separated from the closed position, comprising:

a guide mechanism that guides the platen unit to an intermediate position on a first path of movement between the closed position and the open position;

a six joint linkage mechanism that supports the platen unit guided along the first path of movement in a specific posture and causes the platen unit to move from the intermediate position to the open position along a curved second path of movement while held in a specific posture, the six joint linkage mechanism including a first compound link having a first link and a second link connected in series at a first pin joint, a second compound link having a third link and a fourth link connected in series at second pin joint, and a fifth link connected between the first pin joint of the first compound link and the second pin joint of the second compound link; and a holding mechanism;

wherein a first end of the first compound link and a first end of the second compound link are connected respectively to a third pin joint and a fourth pin joint at defined front and back positions with a specific distance therebetween when the platen unit is seen in a direction opening from the closed position to the open position;

a second end of the first compound link and a second end of the second compound link are connected respectively to a fifth pin joint and a sixth pin joint at defined front and back positions of the platen unit with a specific distance therebetween when seen in the opening direction;

when the platen unit is positioned above the first path of movement, a first gap between the third pin joint and the fifth pin joint, and a second gap between the fourth pin joint and the sixth pin joint, are less than respective maximum gaps therebetween, and when the platen unit moves from the first path of movement to the second path of movement, the first and second gaps increase to their respective maximum gaps;

when the platen unit is on the second path of movement, the holding mechanism holds the first gap between the third pin joint and the fifth pin joint, and the second gap between the fourth pin joint and the sixth pin joint, at the maximum gaps therebetween;

the holding mechanism comprises a tension spring;

a first end of the tension spring is connected to the first pin joint of the first compound link;

a second end of the tension spring is connected to a part of the printer frame positioned to the back of the first pin joint when the platen unit is seen in the opening direction; and the tension spring is held in a specific extended state while the platen frame is on the second path of movement.

6. A printer platen support mechanism that supports a platen unit having a platen that defines a printing position of a print head so that the platen unit can move between a closed position where the platen defines the printing position and an open position separated from the closed position, comprising:

a guide mechanism that guides the platen unit to an intermediate position on a first path of movement between the closed position and the open position;

a six joint linkage mechanism that supports the platen unit guided along the first path of movement in a specific posture and causes the platen unit to move from the intermediate position to the open position along a curved second path of movement while held in a specific posture, the six joint linkage mechanism including a first compound link having a first link and a second link connected in series at a first pin joint, a second compound link having a third link and a fourth link connected in series at a second pin joint, and a fifth link connected between the first pin joint of the first compound link and the second pin joint of the second compound link; and a holding mechanism;

wherein a first end of the first compound link and a first end of the second compound link are connected respectively to a third pin joint and a fourth pin joint at defined front and back positions with a specific distance therebetween when the platen unit is seen in a direction opening from the closed position to the open position;

a second end of the first compound link and a second end of the second compound link are connected respectively to a fifth pin joint and a sixth pin joint at defined front and back positions of the platen unit with a specific distance therebetween when seen in the opening direction;

when the platen unit is positioned above the first path of movement, a first gap between the third pin joint and the fifth pin joint, and a second gap between the fourth pin joint and the sixth pin joint, are less than respective maximum gaps therebetween, and when the platen unit moves from the first path of movement to the second path of movement, the first and second gaps increase to their respective maximum gaps;

when the platen unit is on the second path of movement, the holding mechanism holds the first gap between the third pin joint and the fifth pin joint, and the second gap between the fourth pin joint and the sixth pin joint, at the maximum gaps therebetween;

the holding mechanism comprises a sliding expansion link attached to the six joint linkage mechanism, and a link guide surface disposed to the printer frame;

the sliding expansion link has a fixed-side link of which one end is connected to the fourth pin joint, and a slide-side link of which one end is connected to the sixth pin joint, a slide pin is disposed to another end of the slide-side link, and the slide pin is inserted to a slide channel formed in the fixed-side link so that the slide pin can slide in the slide channel; and when the platen unit moves from the first path of movement to the second path of movement, the slide pin rides onto the link guide surface and the sliding expansion link is held extended, and when the platen unit moves from the second path of movement to the first path of movement, the slide pin separates from the link guide surface and the sliding expansion link can expand and contract freely.

7. A printer platen support mechanism described that supports a platen unit having a platen that defines a printing position of a print head so that the platen unit can move between a closed position where the platen defines the printing position and an open position separated from the closed position, comprising:

a guide mechanism that guides the platen unit to an intermediate position on a first path of movement between the closed position and the open position;

a six joint linkage mechanism that supports the platen unit guided along the first path of movement in a specific posture and causes the platen unit to move from the intermediate position to the open position along a curved second path of movement while held in a specific posture, the six joint linkage mechanism including a first compound link having a first link and a second link connected in series at a first pin joint, a second compound link having a third link and a fourth link connected in series at a second pin joint, and a fifth link connected between the first pin joint of the first compound link and the second pin joint of the second compound link; and a holding mechanism;

wherein a first end of the first compound link and a first end of the second compound link are connected respectively to a third pin joint and a fourth pin joint at defined front and back positions with a specific distance therebetween when the platen unit is seen in a direction opening from the closed position to the open position;

a second end of the first compound link and a second end of the second compound link are connected respectively to a fifth pin joint and a sixth pin joint at defined front and back positions of the platen unit with a specific distance therebetween when seen in the opening direction;

when the platen unit is positioned above the first path of movement, a first gap between the third pin joint and the fifth pin joint, and a second gap between the fourth pin joint and the sixth pin joint, are less than respective maximum gaps therebetween, and when the platen unit moves from the first path of movement to the second path of movement, the first and second gaps increase to their respective maximum gaps;

when the platen unit is on the second path of movement, the holding mechanism holds the first gap between the third pin joint and the fifth pin joint, and the second gap between the fourth pin joint and the sixth pin joint, at the maximum gaps therebetween;

the holding mechanism comprises a sliding expansion link attached to the six joint linkage mechanism, and a link guide surface disposed to the printer frame;

the sliding expansion link has a fixed-side link of which one end is connected to the third pin joint, and a slide-side link of which one end is connected to the fifth pin joint, a slide pin is disposed to another end of the slide-side link, and the slide pin is inserted to a slide channel formed in the fixed-side link so that the slide pin can slide in the slide channel; and when the platen unit moves from the first path of movement to the second path of movement, the slide pin rides onto the link guide surface and the sliding expansion link is held extended, and when the platen unit moves from the second path of movement to the first path of movement, the slide pin separates from the link guide surface and the sliding expansion link can expand and contract freely.

8. A roll paper printer comprising:

a platen support mechanism that supports a platen unit having a platen that defines a printing position of a print head so that the platen unit can move between a closed position where the platen defines the printing position and an open position separated from the closed position, the platen support mechanism comprising a guide mechanism that guides the platen unit to an intermediate position on a first path of movement between the closed position and the open position, and a six joint linkage mechanism that supports the platen unit guided along the first path of movement in a specific posture and causes the platen unit to move from the intermediate position to the open position along a curved second path of movement while held in a specific posture, the six joint linkage mechanism including a first compound link having a first link and a second link connected in series at a first pin joint, a second compound link having a third link and a fourth link connected in series at a second pin joint, and a fifth link connected between the first pin joint of the first compound link and the second pin joint of the second compound link;

a roll paper compartment for storing roll paper;

an access cover that is attached to a front of the printer for opening and closing the roll paper compartment;

wherein a first end of the first compound link and a first end of the second compound link are connected respectively to a third pin joint and a fourth pin joint at defined front and back positions with a specific distance therebetween when the platen unit is seen in a direction opening from the closed position to the open position;

a second end of the first compound link and a second end of the second compound link are connected respectively to a fifth pin joint and a sixth pin joint at defined front and back positions of the platen unit with a specific distance therebetween when seen in the opening direction;

when the platen unit is positioned above the first path of movement, a first gap between the third pin joint and the fifth pin joint, and a second gap between the fourth pin joint and the sixth pin joint, are less than respective maximum gaps therebetween, and when the platen unit moves from the first path of movement to the second path of movement, the first and second gaps increase to their respective maximum gaps;

the closed position of the platen unit is a position where the platen unit is disposed extending in a front-back direction of the printer above the roll paper compartment; wherein the open position of the platen unit is a position where the platen unit is pulled from the roll paper compartment to the printer front and is disposed extending in the front-back direction of the printer at a position lower than the closed position; and the access cover pivots at the bottom end of the access cover and opens and closes in the front-back direction of the printer in conjunction with movement of the platen unit.

9. The roll paper printer described in claim 8, further comprising:

a paper feed roller pair for conveying recording paper delivered from the roll paper stored in the roll paper compartment past the printing position, a first roller of the paper feed roller pair disposed on the platen unit, and a second roller of the paper feed roller pair disposed on a side of a frame of the printer.

10. A roll paper printer comprising:

a roll paper compartment adapted to store roll paper;

a print head;

a platen disposed opposite the print head;

a cover configured to open and close an opening for storing the roll paper in the roll paper compartment;

a platen support mechanism that supports the platen movably to a first position opposite the print head and a second position separated from the print head;

a main frame to which the print head is disposed; and a platen frame to which the platen is disposed and which is configured to move relative to the main frame by the platen support mechanism;

wherein the platen support mechanism comprises a first compound link including a first link and a second link connected at a first joint, a second compound link including a third link and a fourth link connected at a second joint, a fifth link of which a first end is connected to the first joint and a second end is connected to the second joint, the first link and the third link connected to the main frame by a third joint and a fourth joint, and the second link and the fourth link connected to the platen frame by a fifth joint and a sixth joint, and a first guide unit that guides the sixth joint so that the platen moves along a straight first path from the first position to a third position that is located between the first position and the second position;

a first distance between the third joint and the fifth joint, and a second distance between the fourth joint and the sixth joint, change while the sixth joint of the first compound link and the second compound link is guided by the first guide unit and the platen moves from the first position to the third position, and the platen thereby moves along the straight first path, and the first distance between the third joint and the fifth joint, and the second distance between the fourth joint and the sixth joint, are constant and the platen thereby moves along a curved second path while the sixth joint of the first compound link and the second compound link is not guided by the first guide unit and the platen moves from the third position to the second position.

11. The roll paper printer described in claim 10, wherein:

the first guide unit is a channel that is a stepped channel with at least one step, and is formed so that the platen moves away from the print head from the first position to the third position.

12. The roll paper printer described in claim 10, wherein:

the platen support mechanism further comprises a holding mechanism that holds the first distance between the third joint and the fifth joint, and the second distance between the fourth joint and the sixth joint, constant while the platen moves along the second path from the third position to the second position.

13. The roll paper printer described in claim 12, wherein:

the two links of at least one of the first compound link and the second compound link have contact parts that touch each other when the platen is on the second path; and the holding mechanism has an urging member that urges the first joint and the second joint in a direction causing the contact parts of the two links to touch each other.

14. The roll paper printer described in claim 12, wherein:

the holding mechanism comprises a slide link mechanism that is disposed to either the first compound link or the second compound link, and comprises a sixth link with a slot connected to the third joint or the fourth joint, and a seventh link that is connected to the fifth joint or the sixth joint, and has two members that are inserted to the slot, and a second guide unit that is disposed to the main frame and guides one of the two members of the slide link mechanism.

15. A printing device, comprising:

a platen unit coupled to a platen, the platen unit being movable between a closed position, in which the platen defines a printing position of a print head, and an open position; and a linkage mechanism configured to move the platen unit between the open and closed positions, the linkage mechanism comprising a first compound link having a first joint, a second compound link having a second joint, and a link having one end coupled to the first joint and another end coupled to the second joint;

wherein the first and second compound links are configured to respectively pivot at the first and second joints to move the platen unit between the open and closed position;

the first compound link comprises first and second links connected in series at the first joint such that the first and second links can pivot relative to one another about the first joint;

the second compound link comprises third and fourth links connected in series at the second joint such that the third and fourth links can pivot relative to one another about the second joint;

when the platen unit is in the closed position, the first and second compound links are curved such that longitudinal axes of the first and second links are angled relative to one another and longitudinal axes of the third and fourth links are angled relative to one another; and when the platen unit is in the open position, the first and second compound links are extended such that the longitudinal axes of the first and second links are parallel to one another and the longitudinal axes of the third and fourth links are parallel to one another.

16. The printing device described in claim 15, wherein:

one end of the first compound link is coupled to the platen unit at a third joint;

one end of the second compound link is coupled to the platen unit at a fourth joint; and the first and second compound links are configured to respectively pivot at the third and fourth joints to move the platen unit between the open and closed positions.

* * * * *